US005614685A

United States Patent [19]

Matsumoto et al.

[11] Patent Number: 5,614,685

[45] Date of Patent: Mar. 25, 1997

[54] DIGITAL SIGNAL PROCESSOR FOR MUSICAL TONE SYNTHESIZERS AND THE LIKE

[75] Inventors: Shuuichi Matsumoto; Chifumi Takeuchi, both of Hamamatsu, Japan

[73] Assignee: Yamaha Corporation, Hamamatsu, Japan

[21] Appl. No.: 279,719

[22] Filed: Jul. 25, 1994

Related U.S. Application Data

[63] Continuation of Ser. No. 903,998, Jun. 24, 1992, abandoned.

[30] Foreign Application Priority Data

Jun. 27, 1991 [JP] Japan ..... 3-157190

[51] Int. Cl.[6] ..... G10H 7/00

[52] U.S. Cl. ..... 84/602

[58] Field of Search ..... 84/600–602, 617

[56] References Cited

U.S. PATENT DOCUMENTS 4,794,837 1/1989 Katoh ..... 84/607

4,809,577 3/1989 Fujita ..... 84/604

4,916,996 4/1990 Suzuki et al. ..... 84/603

5,046,004 9/1991 Tsumura et al. ..... 84/601 X

*Primary Examiner*—William M. Shoop, Jr.

*Assistant Examiner*—Jeffrey W. Donels

*Attorney, Agent, or Firm*—Loeb & Loeb LLP

[57] ABSTRACT

When a digital signal processor (i.e., DSP) performs a data processing on data stored in a memory (e.g., RAM) in accordance with instructions given from a CPU, data read/write controls are carried out with respect to the data transmitted between the DSP and memory. In accordance with built-in micro-programs, the DSP produces plural musical tone signals in time-division manner. When employing 32-bit data to be processed in the DSP, this 32-bit data is divided into four sets of 8-bit data, which are sequentially written in the memory, for example. Thereafter, the DSP reads such four sets of 8-bit data from the memory, and then, the DSP converts them into the 32-bit data, so that the DSP can perform the predetermined data processing on the converted 32-bit data. Thus, the DSP, employing M-bit data to be processed therein, can be freely coupled with the memory which stores N-bit data (where M≧N), as long as "M" is equal to or a multiple of "N".

15 Claims, 13 Drawing Sheets

DIGITAL SIGNAL PROCESSOR FOR MUSICAL TONE SYNTHESIZERS AND THE LIKE

This is a continuation of application Ser. No. 07/903,998 filed Jun. 24, 1992, now abandoned.

BACKGROUND OF THE INVENTION

1. Field of the Invention

The present invention relates to a musical tone signal processing device which is suitable for use in the sound source synthesizing of the musical tone signals.

2. Prior Art

Generally, in order to synthesize and generate the musical tone signal or impart the sound effect to it, it is required to provide several kinds of operations, processes and much memory capacity. Actually, when configuring the device which generates the musical tone waveform or imparts the sound effect (e.g., reverberation effect) to the musical tone signal, it is required to give a careful consideration to the memory capacity and other control definitions such as the access time and number of bits of the data to be used.

When connecting the musical tone waveform processing device, using the 32-bit musical tone waveform data, to the memory having the predetermined memory capacity, the 32-bit data bus is generally used. In this case, however, by using the 8-bit data bus, it is possible to reduce the number of signal lines in the data bus as compared to the 32-bit data bus, with the result that the cost required for interconnecting the ICs can be reduced.

The above-mentioned theory can be easily proved in the typical example described below.

As an example, when interconnecting two memory systems which employ the same number "B", representing the bits of data, and the same data capacity "C=2$^n$" but different sizes of the data buses, i.e., data buses of "B" bits and "B/a" bits, the first memory system, employing the B-bit data bus, requires the number of data 11nes at "B" and number of address lines at "n", while the second memory system, employing the B/a-bit data bus, requires the number of data 11nes at "B/a" and number of address lines at "n+$\log_2$a".

For example, when "B" is set at "32" and "C" is set at 1MW=$2^{20}$, we study about the following three cases wherein 32-bit, 16-bit and 8-bit data busses are used respectively.

| | | |
|---|---|---|
| ① 32-bit data bus: data lines | = | "32" + address lines "20" |
| | = | total number of lines "52" |
| ② 16-bit data bus: data lines | = | "16" + address lines "21" |
| | = | total number of lines "37" |
| ③ 8-bit data bus: data lines | = | "8" + address lines "22" |
| | = | total number of lines "30" |

The conventional musical tone signal processing device employs the fixed number of bits in the data to be used. For this reason, it is necessary to provide the memory system of which data configuration must match with that of the conventional device, which may raise a drawback in that only the limited kind of memory system can be used. In other words, the customer cannot freely set the connecting specifications (such as the number of data lines to be used) between the processing portion and memory portion. In some cases, it is required to provide the high-price memory or large number of data lines, which may enlarge the size of the substrate board. This is a disadvantage when forming the system.

SUMMARY OF THE INVENTION

It is accordingly a primary object of the present invention to provide a musical tone signal processing device having a relatively large degree of freedom when forming the musical tone processing system.

In an aspect of the present invention, there is provided a musical tone signal processing device comprising:

a first data processing portion which performs a predetermined data processing on M-bit data;

a second data processing portion which preforms another predetermined data processing on N-bit data (where N≦M);

a data converting portion, coupled between the first and second data processing portions, which divides the M-bit data, processed in the first data processing portion, and converts it into the N-bit data so as to sequentially transfer the converted N-bit data to the second data processing portion and which reconverts the N-bit data, processed in the second data processing portion, into the M-bit data on the basis of the divided-data-transfer-order so as to transfer the re-converted M-bit data to the first data processing portion; and a conversion designating portion which supplies values representative of M and N bits to the data converting portion and which also gives instructions representative of the data conversion procedure to the data converting portion.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 2A shows the data configuration of parameter data, while

DESCRIPTION OF THE PREFERRED EMBODIMENTS

Figure 1:
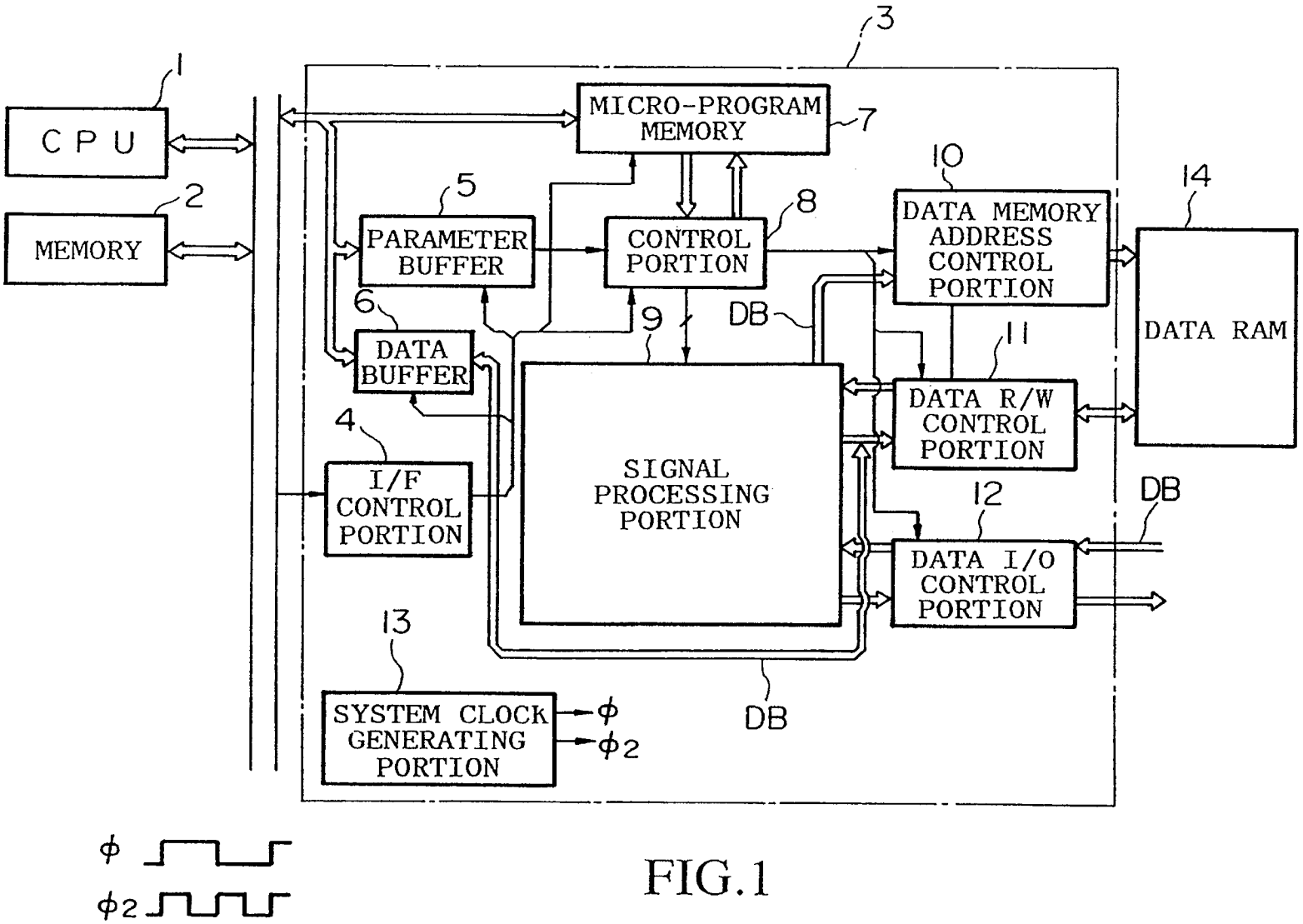
FIG. 1 is a block diagram showing an electric configuration of a musical tone signal processing device according to an embodiment of the present invention.

Next, description will be given with respect to an embodiment of the present invention by referring to the drawings.

[A] Configuration

FIG. 1 is a block diagram showing the whole configuration of the musical tone signal processing device according to an embodiment of the present invention. In FIG. 1, a central processing unit (i.e., CPU) 1 is provided to perform the data read/write timing control and the like with respect to a digital signal processor (i.e., DSP) 3. In addition, a memory 2 memorizes programs, used for the controls made by the CPU 1, and data, representing the operation results and the like.

Next, the DSP 3 is designed as a data processing circuit, embodying the sound source which simulates the sounds of the non-electronic musical instruments. This DSP 3 is configured by an interface (I/F) control portion 4, a parameter buffer 5, a data buffer 6, a micro-program memory 7, a control portion 8, a signal processing portion 9, a data-memory-address control portion 10, a data read/write (R/W) control portion 11, a data input/output (I/O) control portion 12 and a system clock generating portion 13. In accordance with the commands and instructions from the CPU 1, this DSP 3 computes addresses and the like for the external data memory, i.e., a data random-access memory (RAM) 14.

The I/F control portion 4 performs a timing control on the instructions (e.g., data read/write instructions), given from the CPU 1, for the DSP 3. In order to do so, this portion 4 delivers control signals to the parameter buffer 5, data buffer 6, micro-program memory 7 and control portion 8.

The parameter buffer 5 receives and stores several kinds of parameter data (of which details will be described later) from the CPU 1, wherein such parameter data concern the data processings to be performed by the DSP 3. This parameter data is supplied to the control portion 8 at the predetermined timing in accordance with the foregoing control signal. Meanwhile, the computing result of the DSP 3 is read out and then written in the data RAM 14. At this time, the data buffer 6 temporarily stores the data representing the computing result of the DSP 3. In accordance with the foregoing control signal, this data buffer 6 performs the data input/output operation at the predetermined timing.

The micro-program memory 7 stores micro-programs representing the data-processing procedures of the DSP 3. This memory 7 sequentially outputs instructions to the control portion 8 at the predetermined timings. The control portion 8 is provided to perform the overall control on the DSP 3. For example, it designates the operation timings or gives instructions concerning the data processings to be made in accordance with the micro-programs. This control portion 8 contains a program counter (PC) to access the micro-program.

In accordance with the instructions from the control portion 8, the signal processing portion 9 performs several kinds of data processings. At this time, the signal processing portion 9 generates several kinds of controls signals, used for performing the address controls on the data RAM 14, and delivers them to the data memory address control portion 10, data R/W control portion 11 and data I/0 control portion 12. The data memory address control portion 10 generates address signals to perform the access controls on the data RAM 14.

The data R/W control portion 11 performs a data input/output control between the data RAM 14 and DSP 3. In order to do so, the data R/W control portion 11 outputs control signals to the data memory address control portion 10. In accordance with the instructions (i.e., control signals) from the control portion 8, the data I/O control portion 12 performs a data input/output control on data to be transmitted between the DSP 3 and the external device or system.

Incidentally, data transmission is made by means of data busses DB.

Next, description will be given with respect to the foregoing parameter data and micro-programs by referring to FIGS. 2A, 2B. Herein, FIG. 2A shows the configuration of the data stored in the parameter buffer 5. As the parameter data, this parameter buffer 5 stores several kinds of data, represented as "RAM MODE", "CLR START STEP", "CLR END STEP", "CLR ST", "CLR RNG" and "CLR COMMAND". Each of them is read out and outputted from the parameter buffer 5 at the predetermined timing in accordance with the instructions from the CPU 1.

The above-mentioned "RAM MODE" represents the variable data by which the bit-size of the data bus is set, wherein it can be set at one of these values: "0", "1", "2", "3". When it is set at "0", a 32-bit data bus is employed for 32-bit data (indicated as AI0=0, AI1=0). When it is at "1", a 16-bit data bus is employed for 32-bit data (indicated as AI0=1, AI1=0). When it is at "2", an 8-bit, data bus is employed for 24-bit data (indicated as AI0=0, AI1=1). When it is at "3", an 8-bit data bus is employed for 32-bit data (indicated as AI0=1, AI1=1).

Next, data "CLR START STEP" represents a micro-program step address at which the memory clear operation is started. "CLR END STEP" represents another micro-program step address at which the memory clear operation is ended. Further, "CLR ST" represents the head address of the memory to be cleared; "CLR RNG" represents the data quantity of the memory to be cleared; and "CLR COMMAND" represents the command or instruction for clearing the memory.

Figure 2B:
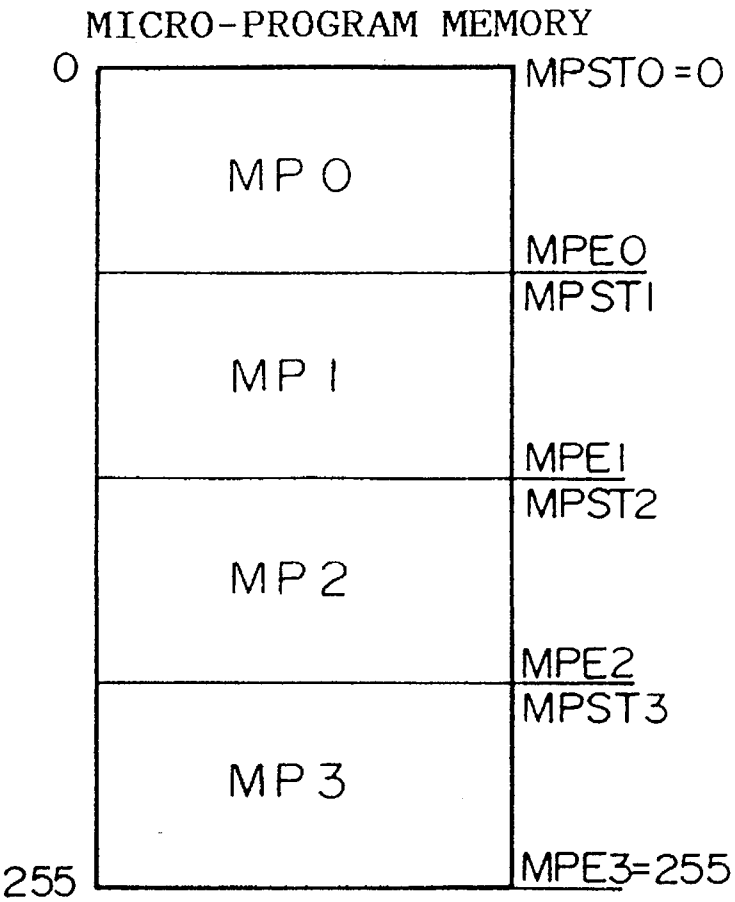
FIG. 2B shows the configuration of micro-programs.
Figure 2A:
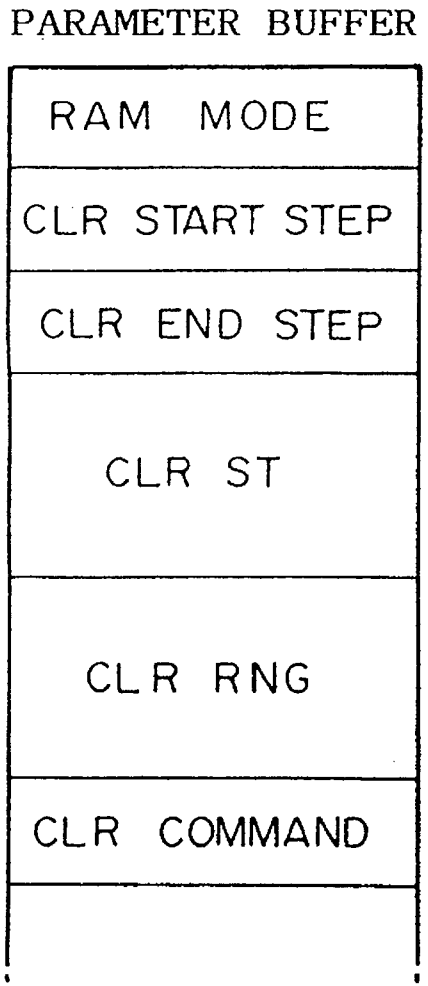

FIG. 2B shows the micro-programs to be stored in the micro-program memory 7. Herein, the micro-program memory 7 stores 256 steps of programs, containing micro-programs MP0, MP1, MP2, MP3. Each of these mlcro-programs corresponds to the musical tone generating program by which one musical tone is to be synthesized. In this embodiment, normally four musical tones can be synthesized in a time-division manner.

When completing the generation of the musical tone, the memory area correspondlng to its micro-program is designated by the parameter data "CLR START STEP" and "CLR END STEP", and then "CLR COMMAND" is set. When thls data "CLR COMMAND" is set, the memory clear operation is carried out as long as the corresponding micro-program is executed. In other words, while the DSP 3 is operating with respect to the micro-program designated by "START STEP" and "END STEP", the CPU 1 performs the memory clear operation (wherein data "0" is written into the data RAM 14).

Figure 3:
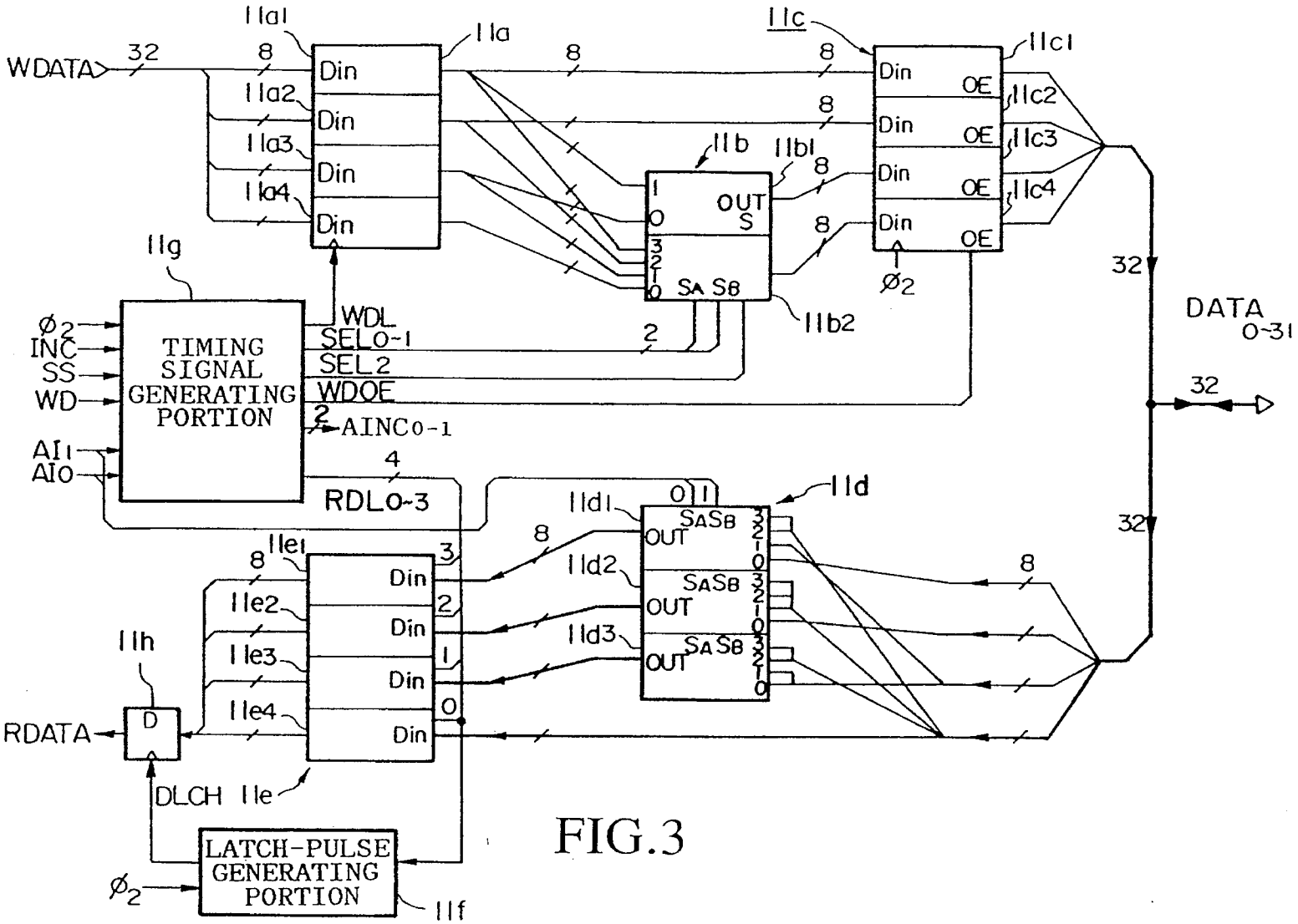
FIG. 3 is a circuit diagram showing a detailed configuration of a data R/W control portion 11 shown in FIG. 1.

FIG. 3 is a circuit diagram showing the detailed configuration of the data R/W control portion 11. The data R/W control portion 11 contains a write data register 11*a*, a selector 11*b* and a write data buffer 11*c*, which are used for the data recombination to be made when writing the data; a selector 11*d*, a read data buffer 11*e* and a latch-pulse generating portion 11*f*, which are used for the data recombination, to be made when reading the data; and a timing signal generating portion 11*g*. This timing signal generating portion 11*g* generates and delivers several kinds of timing signals and control signals which are used to smoothly perform the data recombination and data division with respect to the above-mentioned circuit portions 11*a*–11*f*.

Figure 4:
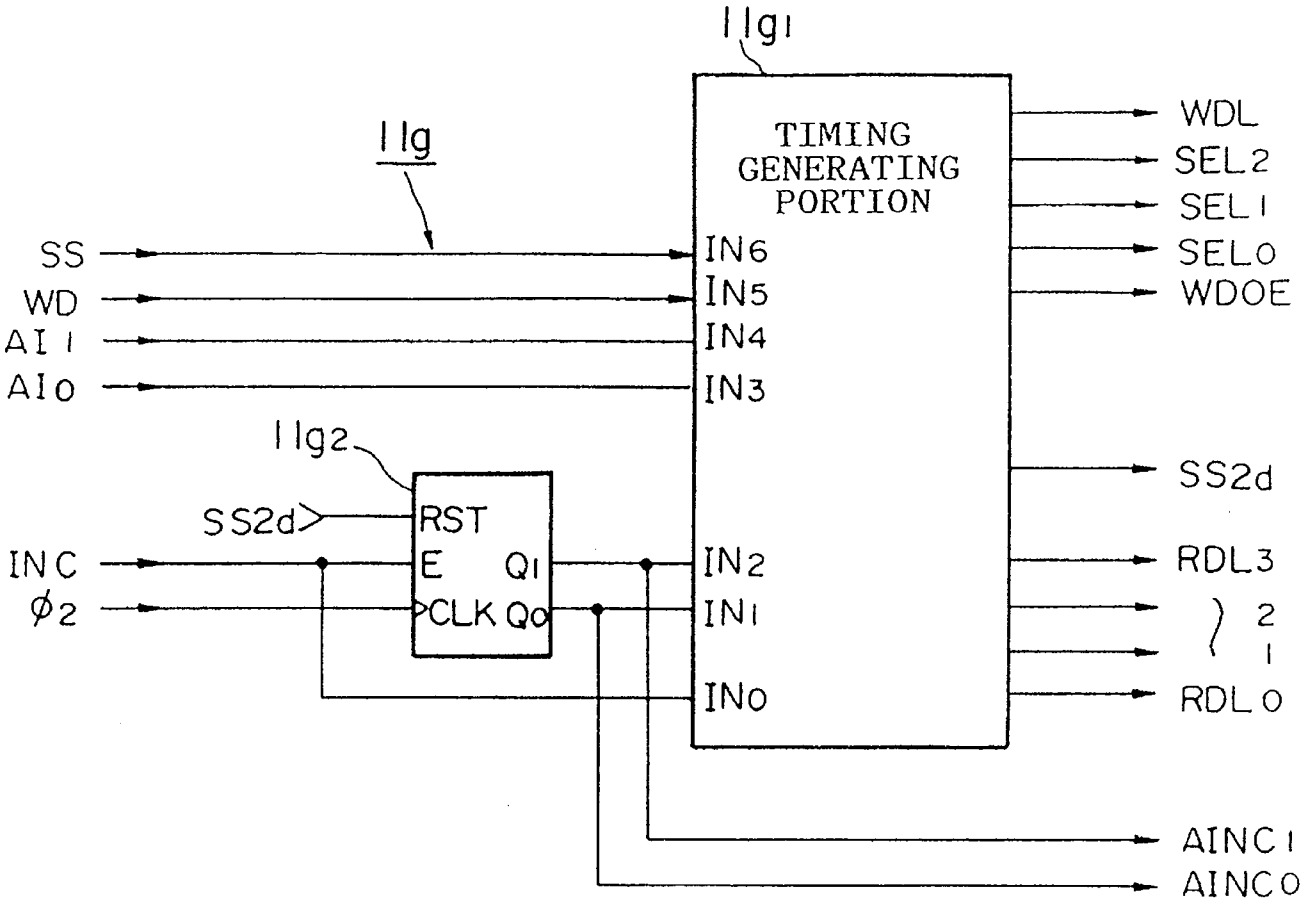
FIG. 4 is a circuit diagram showing detailed configuration of a timing signal generating portion 11*g* shown in FIG. 3.

FIG. 4 shows the detailed configuration of the timing signal generating portion 11*g*. Herein, this timing signal generating portion 11*g* consists of a timing generating portion 11*g*1 and an ADLB counter 11*g*2. This timing generating portion 11g1 receives a memory-access-sequence start signal SS given from the control portion 8, a memory write signal WD to be given thereto when executing the instructions/processings concerning the data writing operation, and designation signals AI0, AI1 which designate the interconnection manner with respect to the memory. On the other hand, the ADLB (i.e., Address Low Bits) counter 11g2 receives a system clock $\phi_2$ and an address-update designating signal INC given from the control portion 8. In accordance with the address-update designating signal INC, this ADLB counter 11g2 produces low-order-address updating signals AINC0, AINC1, which are supplied to input terminals IN1, IN2 of the timing generating portion 11g1 and also supplied to the data-memory-address control portion 10.

In accordance with the above-mentioned signals, the timing generating portion 11g1 outputs a latch-timing signal WDL, used for retaining the data, to the write data register 11a, while it also outputs recombination selecting signals SEL0, SEL1, SEL2, used for re-combining (i.e., changing) the bit size of data, to the selector 11b. In order to output the data stored in the write data buffer 11c, the timing generating portion 11g1 outputs an output control signal WDOE to an OE-terminal of the write data buffer 11c. Further, the timing generating portion 11g1 also delivers latch timing signals RDL0, RDL1, RDL2, RDL3, used for retaining the data, to the read data buffer 11e.

Next, the write data register 11a shown in FIG. 3 is configured by four 8-bit registers to be connected together in parallel. Herein, 32-bit write data WDATA to be written into the data RAM 14 is divided into four sets of 8-bit data which are respectively stored in four registers 11a1, 11a2, 11a3, 11a4 in accordance with the foregoing latch timing signal WDL.

The selector 11d is designed as the selecting means used for re-combining the bit size of data. In accordance with the recombination selecting signals SEL0, SEL1, the 8-bit write data WDATA stored in any one of the 8-bit registers contained in the write data register 11a is written into any one of buffers 11c3, 11c4 contained in the write data buffer 11c via the selector 11b.

The write data buffer 11c has the similar configuration of the write data register 11a. In accordance with the output control signal WDOE, the data (i.e., WDATA) written in the registers 11c1, 11c2, 11c3, 11c4 contained in the write data buffer 11c are outputted to the data RAM 14.

Like the selector 11b, the selector 11d is designed as the selecting means used for re-combining the bit size of data, wherein it contains three selectors 11d1, 11d2, 11d3. In accordance with the designation signals AI0, AI1 used for designating the interconnection manner with respect to the data RAM 14, 8-bit data DATA sequentially outputted from the data RAM 14 are respectively written into four buffers contained in the read data buffer 11e.

Like the write data buffer, the read data buffer 11e consists of four buffers 11e1, 11e2, 11e3, 11e4. In accordance with the latch timings RDL0–RDL3, the 8-bit data DATA written in each buffer of the read data buffer 11e is selectively outputted to a 32-bit latch circuit 11h as read data RDATA.

When the 8-bit data is stored in each buffer of the read data buffer 11e, the latch-pulse generating portion 11f generates and outputs a latch signal DLCH to the latch circuit 11h in accordance with the latch timings RDL0–RDL3. In accordance with the latch signal DLCH, the latch circuitllh reads out four sets of 8-bit data stored in the read data buffer 11e as 32-bit parallel data, which is then outputted to the data bus DB.

Figure 5:
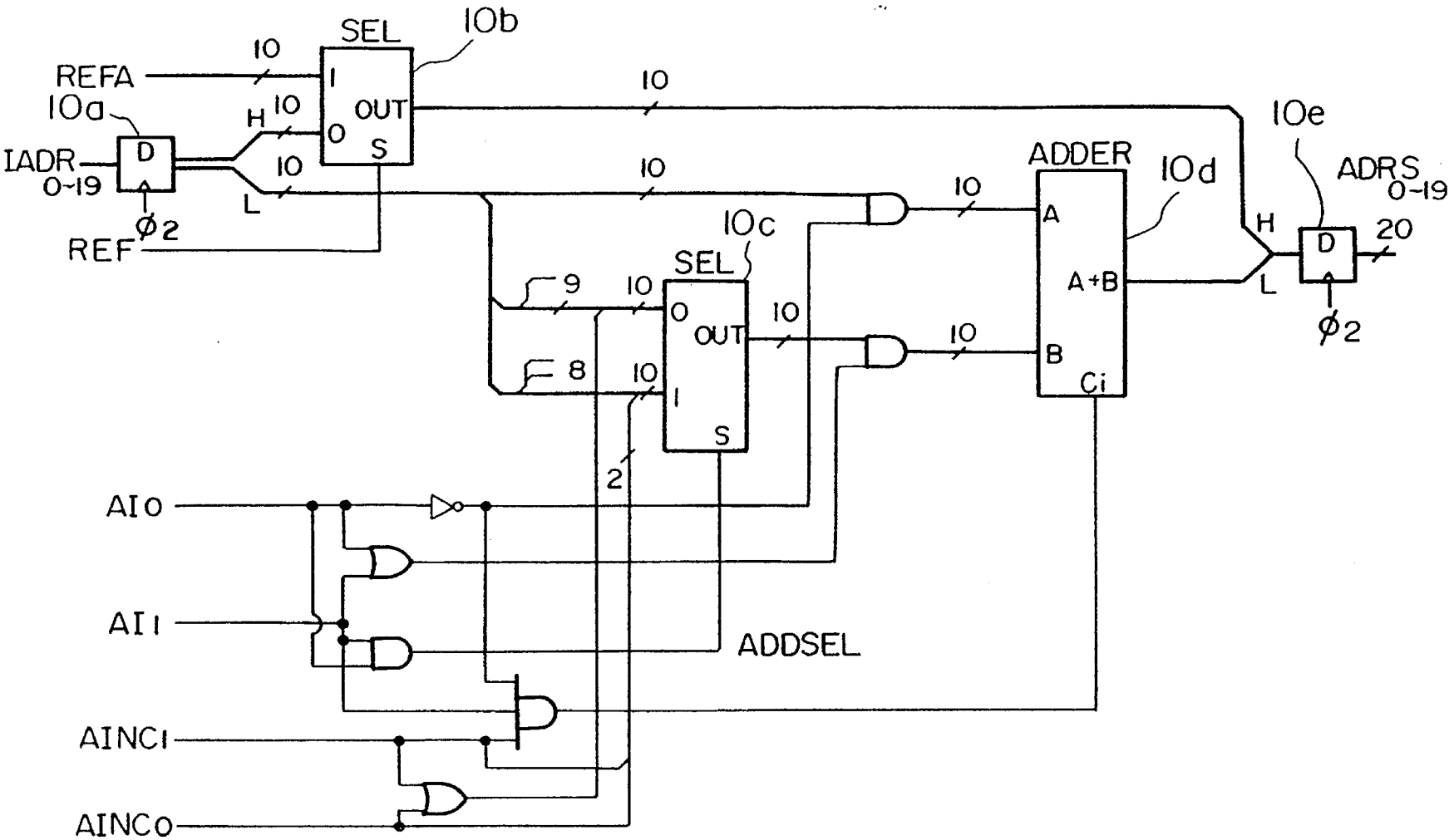
FIGS. 5, 6, 7 are circuit diagrams each showing a specific part of a data-memory-address control portion 10 shown in FIG. 1.

Next, FIG. 5 is a circuit diagram showing the detailed configuration of the first part of the data-memory-address control portion 10 shown in FIG. 1. As shown in FIG. 5, the data-memory-address control portion 10 is configured by a latch circuit (i.e., flip-flop) 10a, selectors 10b, 10c, an adder 10d, a latch circuit 10e and other circuit elements.

While being supplied with a timing signal REF representing a memory refresh period, the selector 10b selects a memory refresh address REFA as the high-order address by which the data RAM 14 is accessed, and this memory refresh address REFA is supplied to the latch circuit 10e. Incidentally, the latch circuit 10a holds 20-bit memory address IADR0–IADR19 representing the internal addresses of the DSP. If the selector 10b is not supplied with the timing signal REF, the selector 10b Selects the high-order address of the above-mentioned memory address as the high-order address by which the data RAM is accessed, and this address is supplied to the latch circuit 10e.

Meanwhile, the selector 10c modifies the low-order address of the 20-bit memory address IADR0–IADR19 in accordance with the foregoing designation signals AI0, AI1 and low-order-address updating signals AINC0, AINC1, and then the modified low-order address is supplied to a second input terminal B of the adder 10d.

In addition, the low-order address of the memory address IADR0–IADR1 is directly supplied to a first input terminal A of the adder 10d (via an AND circuit). This adder 10d selectively outputs the desirable low-order address to the latch circuit 10e at the refresh time or access time.

The latch circuit 10e combines the above-mentioned high-order and low-order addresses together in synchronism with the system clock $\phi_2$, so as to produce 20-bit address ADRS0–ADRS19, which is outputted to the data RAM 14.

Figure 6:
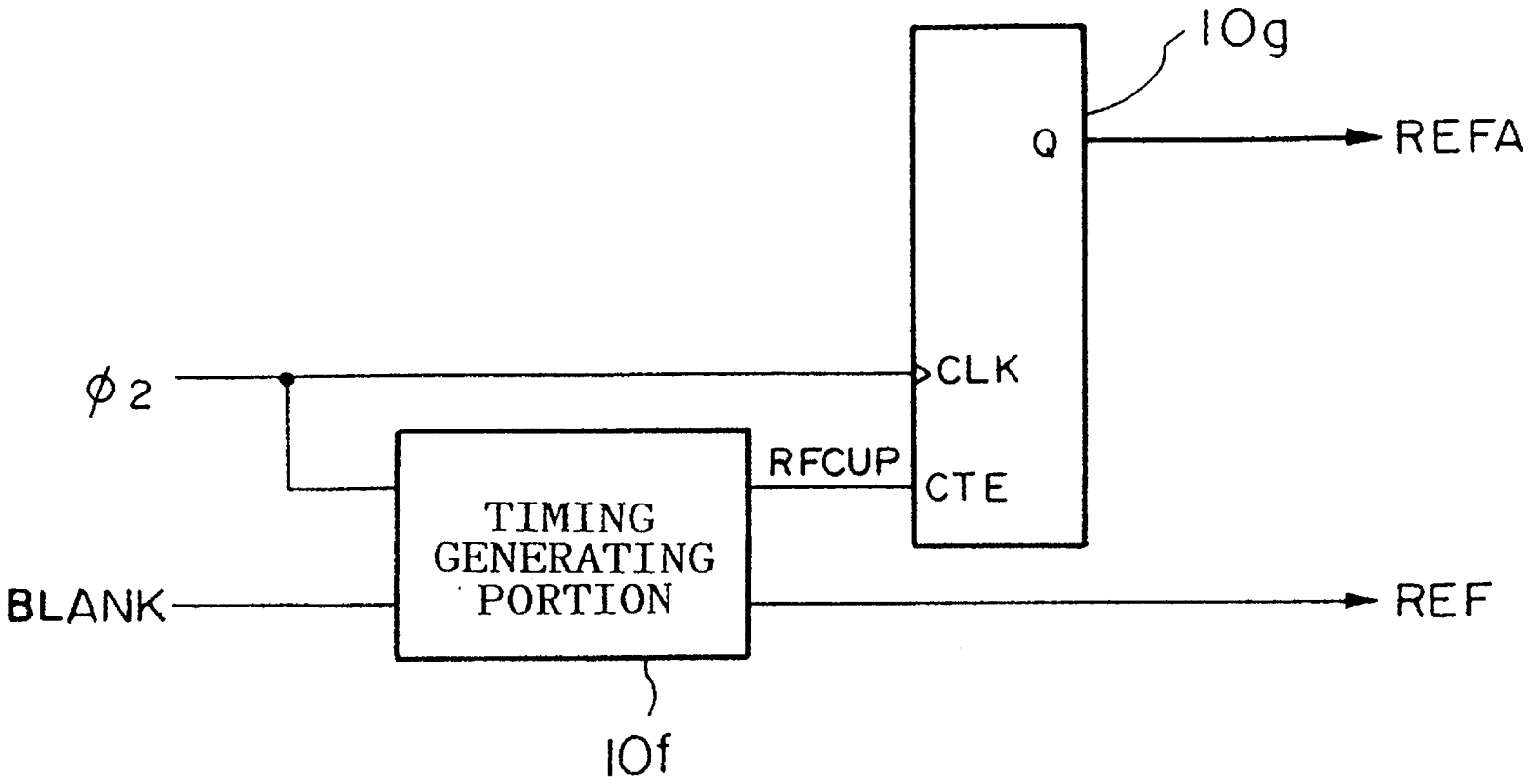

Next, FIG. 6 is a circuit diagram showing the second part of the data-memory-address control portion 10, concerning the refresh counter which produces the refresh address REFA and the timing signal REF representing the refresh period. In FIG. 6, a timing generating circuit 10f produces the timing signal REF on the basis of the system clock $\phi_2$ and a blank signal BLANK representing that the data RAM 14 is not iaccessed during the cyclic period of $\phi_2$. In addition, a REF counter 10g produces the refresh address REFA on the basis ofithe system clock $\phi_2$ and a signal RFCUP produced by the timing generating circuit 10f.

Figure 7:
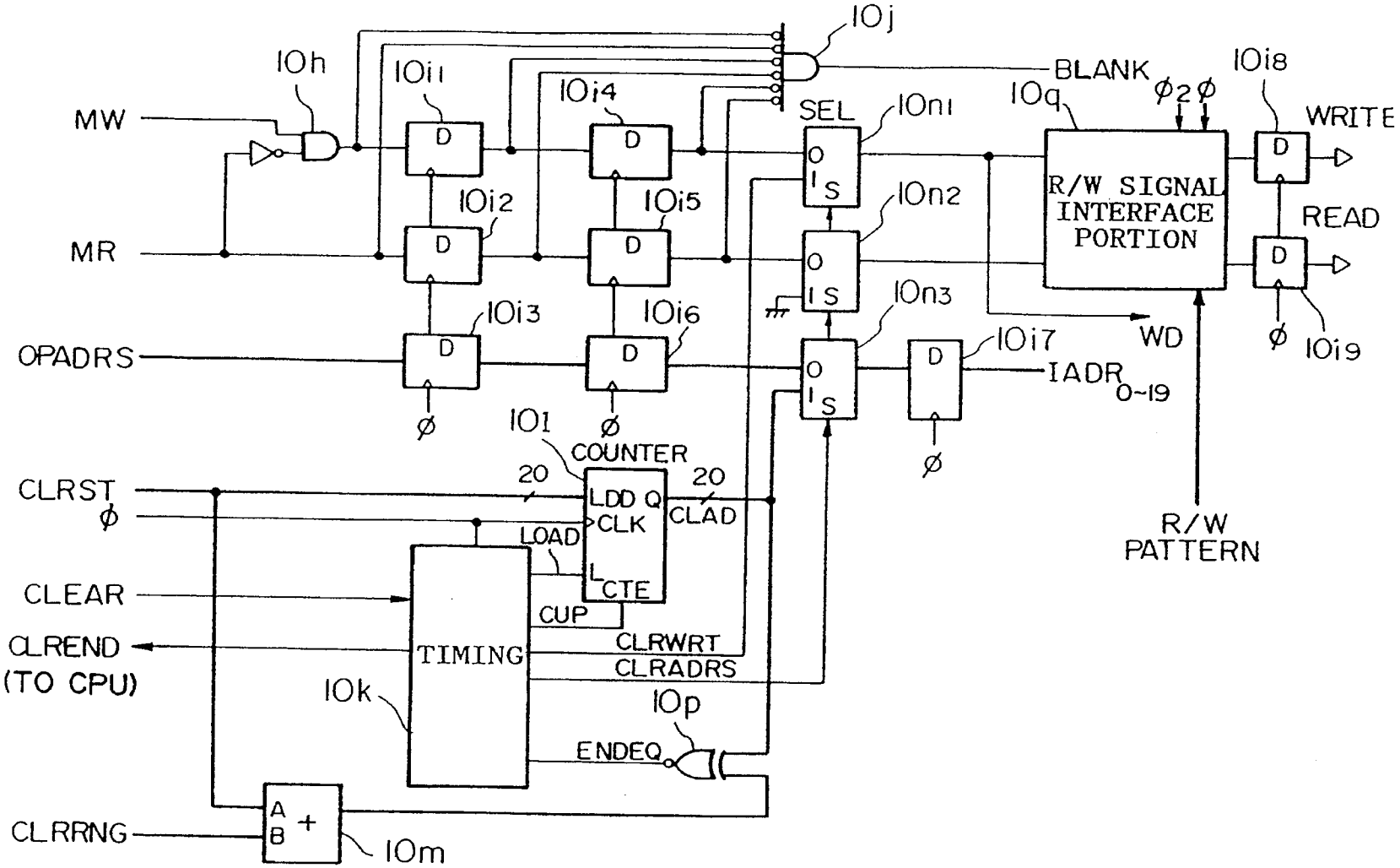

Next, FIG. 7 is a circuit diagram showing the third part of the data-memory-address control portion 10, concerning the clear address generating portion which generates the address at which the data RAM 14 is cleared. In FIG. 7, the circuit portion, which contains an AND circuit 10h, latch circuits (i.e., flip-flops) 10i1–10i6 and an AND circuit 10j having six negative-input terminals, generates the blank signal BLANK on the basis of a memory write signal MW, a memory read sliignal MR and address data OPADRSO–OPADRS19 given from the signal processing portion 9. Herein, this blank signal BLANK represents that the data RAM 14 is not accessed during three cyclic-periods, and this signal is supplied to the foregoing timing generating circuit 10f coupled with the refresh counter 10g shown in FIG. 6.

When receiving a clear-start designating signal CLEAR, a timing generating circuit 10k generates a memory-clear-start-address load signal LOAD and a memory-clear-address-update designating signal CUP in synchronism with a clock $\phi$, and then, these signals LOAD and CUP signal to a counter 101. In addition, this timing generating circuit 10k outputs a memory write signal CLRWRT, to be generated at the memory clear timing, to terminal "1" of a selector 10n1. Similarly, it also outputs a memory-clear-address-output selecting signal CLRADRS to select-terminals "S" of selectors 10n1 to 10n3.

On the basis of the memory-clear-start-address load signal LOAD, memory-clear-address-update designsting signal CUP and memory-clear-start-address data CLRST, the counter 101 generates a clear address CLAD, which is supplied to terminal "1" of the selector **10*n*3 and a first input of exclusive NOR circuit 10*p*. Meanwhile, an adder 10*m* adds the memory-clear-start-address data CLRST to clear range data CLRRNG representing the memory clear range (i.e., amount of the memory to be cleared). The addition result of the adder 10*m* is supplied to a second input of the exclusive NOR circuit 10*p*. This exclusive NOR circuit 10*p* performs the exclusive-NOR operation on the clear address CLAD and addition result of the adder 10*m*, so as to compute and output a memory-clear-end-address detecting signal ENDEQ to the timing generating circuit 10*k***.

When the memory-clear-address-outpUt selecting signal CLRADRS is raised up to the high level, the selector **10*n*1 selectively outputs the memory write signal CLRWRT to a R/W signal interface portion 10*q*. On the other hand, when CLRADRS is at the low level, it selectively outputs the foregoing memory write signal MW to the R/W signal interface portion 10*q***.

When the memory-clear-address-output selecting signal CLRADRS is at the high level, the selector **10*n*2 selectively outputs the predetermined low-level signal to the R/W signal interface portion 10*q*. On the other hand, when CLRADRS is at the low level, it selectively outputs the foregoing memory read signal MR to the R/W signal interface portion 10*q***.

When the memory-clear-address-output selecting signal CLRADRS is at the high level, the selector **10*n*3 selectively outputs the clear address CLAD to a latch circuit (i.e., flip-flop) 10*i*7. On the other hand, when CLRADRS is at the low level, it sequentially outputs the address data OPADRS0–OPADRS19 to the latch circuit 10*i*7. Then, tile latch circuit 10*i*7 outputs the clear address CLAD or address data OPADRS0–OPADRS19 to the foregoing latch circuit 10*a* shown in FIG. 5 as the memory addresses IADR0–IADR19 representing the internal addresses of the DSP 3**.

On the basis of the memory read slgnal MR and memory write signal MW, the R/W signal interface portion **10*q* decides how to configure and output data-memory-write signal WRITE and data-memory-read signal READ. Herein, pattern data "R/W PATTERN" represents how to program the generation patterns of the signals WRITE, READ to the R/W signal interface portion 10*q*. In accordance with this pattern data, the R/W signal interface portion 10*q* generates the data-memory-write signal WRITE and data-memory-read signal READ, which are respectively supplied to latch circuits 10*i*8, 10*i*9. These latch circuits 10*i*8, 10*i*9 deliver the data-memory-write signal WRITE and data-memory-read signal READ to the data RAM 14** respectively at the timings synchronized with the clock $\phi$.

[B] Operation

Next, description will be given with respect to the operations of the musical tone signal processing device having the configuration as shown in FIGS. 1–7 by referring to FIGS. 8–13. Herein, the operation will be described with respect to several cases wherein m-bit data is written in or read from n-bit memory (where m=32, 24, . . . , n=32, 16, . . . ).

(1) 32-Bit Data: 32-Bit Memory

Figure 8:
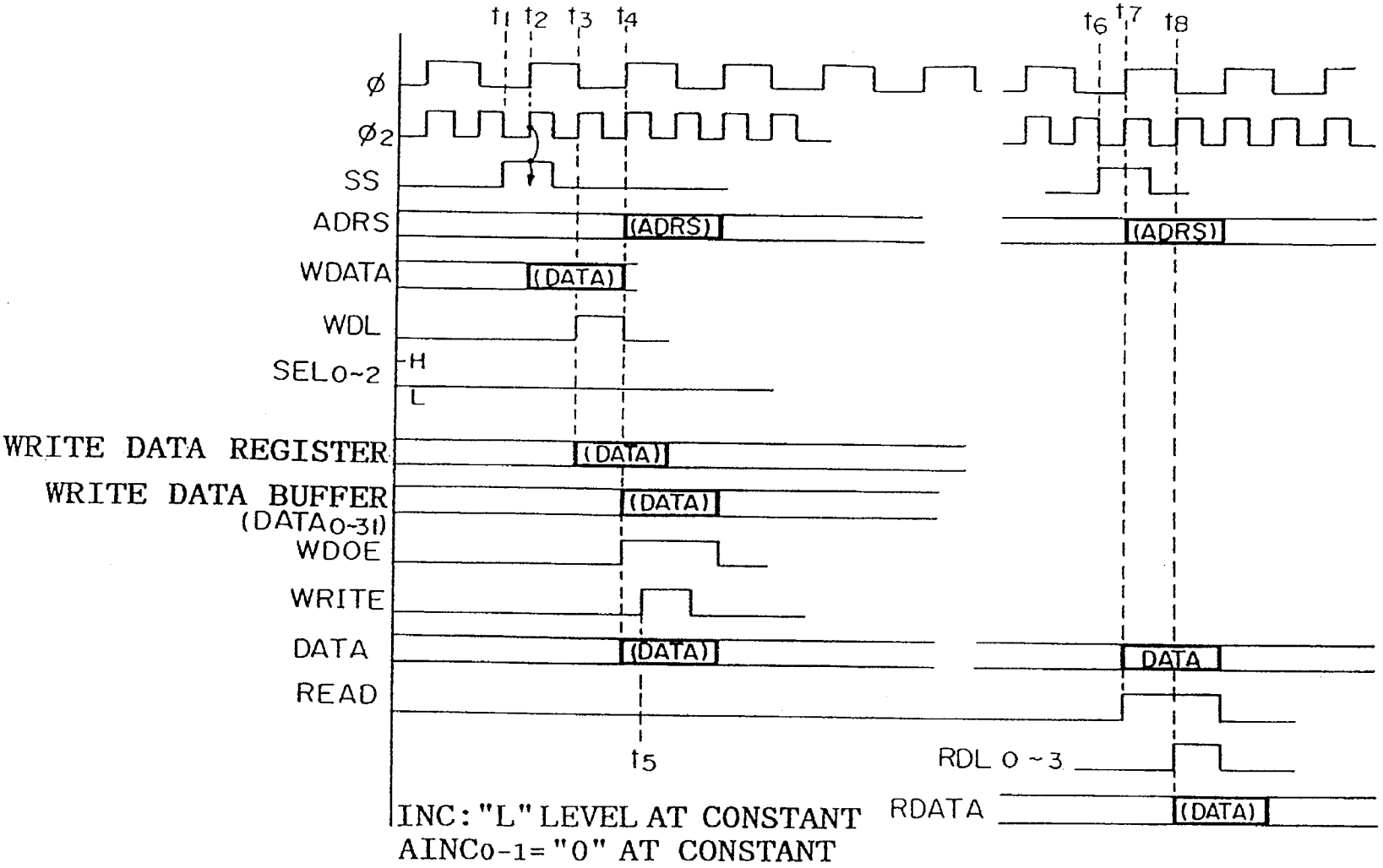
FIGS. 8 to 11 are timing charts each, applied to the specific case where m-bit data is written in or read from n-bit memory (where m=32, 24, . . . ; n=32, 16, . . . ), showing the read/write timings at several portions of the device.

In the first case, the 32-bit data is directly written in or read from the 32-bit memory. FIG. 8 is a timing chart, applied to this case, showing the read/write timings at several portions of the device.

<WRITE OPERATION>

Firstly, description will be given with respect to the writing operation of the 32-bit data in This first case. The system clock generating portion 13 outputs the clocks $\phi$, $\phi_2$ to several portions of the device, wherein the period of $\phi_2$ is set identical to the half period of $\phi$. At time t1 shown in FIG. 8, the control portion 8 outputs the memory-access-sequence start signal SS to the timing signal generating portion **11*g* (see FIG. 3). At the leading edge timing (i.e., time t2) of the clock $\phi_2$, the 32-bit write data WDATA is outputted onto the data bus DB. At the next leading edge timing (i.e., $t_3$) of the clock $\phi_2$, the timing signal generating portion 11*g* raises the latch timing signal WDL up to the high level. At this timing when the latch timing signal WDL rises up to the high level, every 8-bit data of the 32-bit write data WDATA is latched in and then outputted from the write data register 11*a***.

Meanwhile, the foregoing recombination selecting signals SEL0–SEL2 are used for selectively performing the bit-size recombination process. In the above-mentioned case, however, there is no need to re-combine the bit size of data, so that these signals SEL0–SEL2 are in the low-level state. Therefore, the write data WDATA outputted from the write data register **11*a* is supplied to and then stored in the write data buffer 11*c* as it is. At the next time t4, the output control signal WDOE is raised up to the high level, so that the write data WDATA stored in the write data buffer 11*c* is outputted onto the data bus DB. At this time, the address control portion shown in FIG. 5 outputs the address ADRS representing the write address. At time t5 when the control portion 8 raises the write signal WRITE up to the high level (under the state where the read signal READ is at the low level), the write data WDATA to be transmitted onto the data bus DB is written lnto the data RAM 14**.

<READ OPERATION>

Next, the reading operation will be described. At time t6 the control portion 8 outputs the memory-access-sequence start signal SS to the timing signal generating portion **11*g*. At the leading edge timing of $\phi_2$ (i.e., time t7), the address control portion shown in FIG. 5 outputs the address ADRS representing the read address, while the control portion 8 raises the read signal READ up to the high level. When this read signal READ rises up to the high level, the data RAM 14** outputs the data DATA onto the data bus in accordance with tile address ADRS.

At time t8 when the control portion 8 raises the latch-timing signals RDL0–RDL3 up to the high level, the foregoing data DATA passes through the selector **11*d* and then it is stored in the read data buffer 11*e*, from which it ls outputted to the latch circuit 11*h*. Then, the latch-pulse generating portion 11*f* raises the data-latch slgnal DLCH (not shown) up to the high level in accordance with the latch-timing signals RDL0–RDL3. At this time, the 32-bit data DATA outputted from the read data buffer 11*e* is latched in the latch circuit 11*h***, from which it is outputted onto the data bus DB as the read data DATA.

(2) 32-Blt Data: 16-Bit Memory (two-piece data-division)

Figure 9:
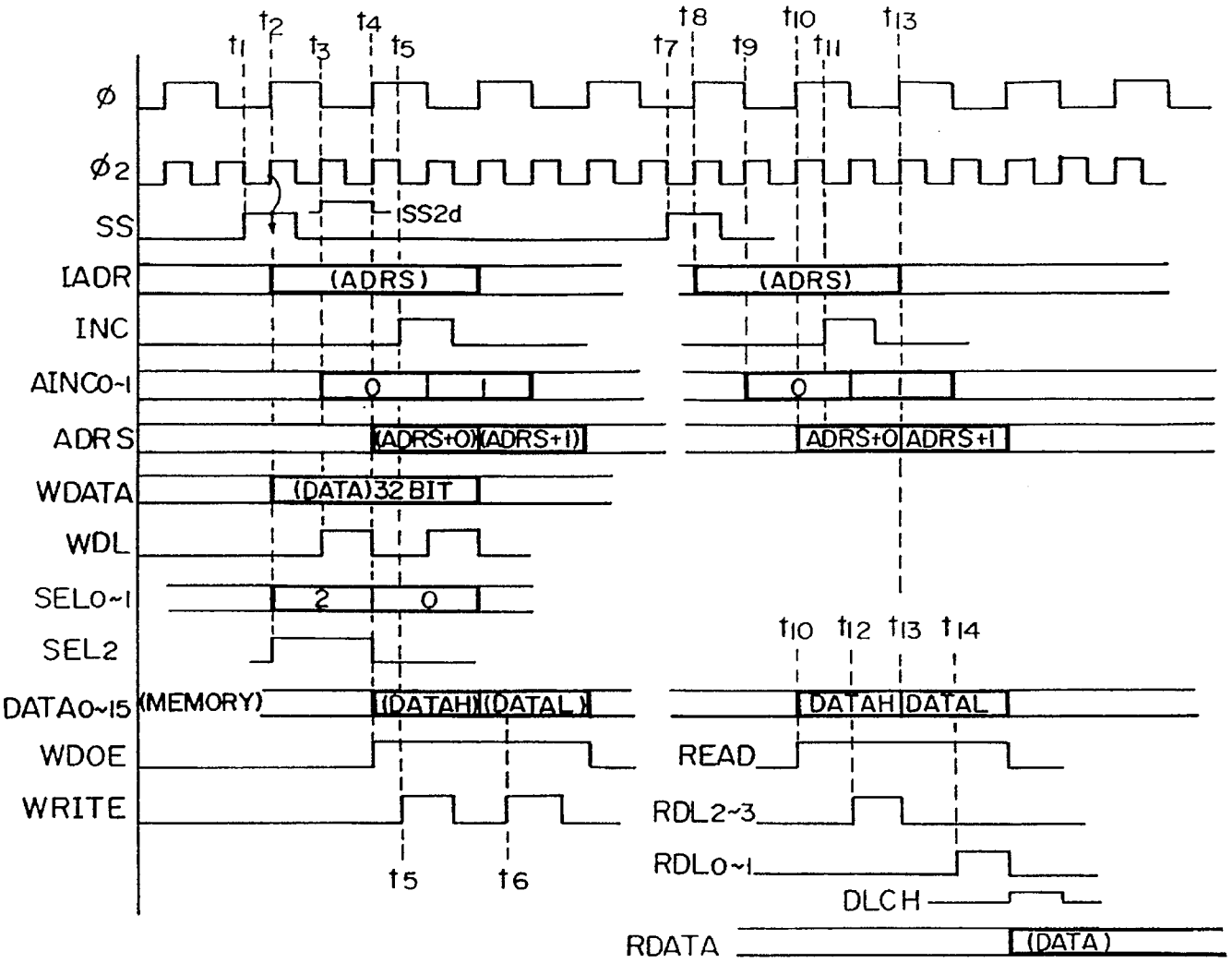

FIG. 9 ls a tlmlng chart showing the read/write timings at several portions of the device wherein the 32-bit data is divided into two pieces on which the read/write operation is performed by use of the 16-bit memory. In thls case, 16-bit data is transmitted between the data RAM 14 and write data buffer **11*c* (see FIG. 3), wherein two buffers 11*c*3, 11*c*4 are used when writing the data. Similarly, in the read-side portion of the data R/W control portion 11 (see FIG. 3**), the 16-bit data is outputted onto the data bus at its low-order-16-bit portion.

<WRITE OPERATION>

Firstly, the writing operation will be described. At time t1 in FIG. 9, the control portion 8 outputs the memory-access-sequence start signal SS to the timing signal generating portion 11*g*. At the leading edge timing of the clock $\phi_2$ (i.e., time t2), the 32-bit write data WDATA is outputted onto the data bus DB. At this time, the value of 2-bit data consisting of the selecting signals SEL0, SEL1 is set at "2", while another selecting signal SEL2 is set at the high level. At the next leading edge timing of the clock $\phi_2$ (i.e., time t3), the timing signal generating portion 11*g* sets the latch-timing signal WDL at the high level, and it also sets the low-order-address updating signals AINC0, AINC1 at "0". At this time when the latch-timing signal WDL is set at the high level, every 8-bit data of the 32-bit write data WDATA is latched in the write data register 11*a*, from which it is outputted.

In this case, the bit-size recombination selecting signals SEL0–SEL2 are set at the above-mentioned Values respectively. Herein, the write data register 11*a* outputs the higher-order bits 17–24 of the write data WDATA, i.e., WDATA16–WDATA23, which are selected by the selector 11*b*2 and then stored in the buffer 11*c*4 of the write data buffer 11*c*. Similarly, the other higher-order bits 25–32 of the write data WDATA, i.e., WDATA24–WDATA31, are selected by the selector 11*b*1 and then stored in the buffer 11*c*3 of the write data buffer 11*c*.

At the next time t4, the output control signal WDOE is raised up to the high level, so that the above-mentioned write data WDATA stored in the write data buffer 11*c* is outputted onto the data bus. At this time, the foregoing address control portion (see FIG. 5) outputs the address ADRS representing the write address on the basis of the low-order-address updating signals AINC0, AINC1 (both set at "0"), designation signals AI0, AI1 (respectively set at "1", "0"), etc. In this case, the address data ADRS represents the write addresses for the higher-order-bit write data WDATA16–WDATA31 (see "ADRS+0" in FIG. 9). At time t5 when the control portion 8 raises the write signal WRITE up to the high level (under the state where the read signal READ is in the low level, naturally), the higher-order-bit write data WDATA16–WDATA31 is written into the data RAM 14 at the predetermined address.

At the foregoing time t4, the latch-timing signal WDL is once set at the low level, while the 2-bit data consisting of the selecting signals SEL0, SEL1 is set at "00" and the selecting signal SEL2 is set at the low level. At time t6, the latch-timing signal WDL is set at the high level, so that the write data WDATA ls latched by the write data register 11*a*. In this case, the bit-size recombination selecting signals SEL0–SEL2 to be supplied to the selector 11*b* are set at the above-mentioned values respectively, so that the selector 11*b*2 selects the lower-order bits 1–8 of the write data WDATA outputted from the write data register 11*a*, i.e., WDATA0–WDATA7, which is then stored in the buffer 11*c*4 of the write data buffer 11*c*. On the other hand, the selector 11*b*1 selects the lower-order bits 9–16 of the write data WDATA, i.e., WDATA8–WDATA15, which is then stored in the buffer 11*c*3 of the write data buffer 11*c*.

At time t5, both the write signal WRITE and address-update designating signal INC are set at the high level. At the next leading edge timing of the clock $\phi_2$ after the time t5, a pair of the address-update designating signals AINC0, AINC1, outputted from the timing signal control portion (see FIG. 4), is set at "01". As a result, the address ADRS will represent the write address for the lower-order-bit write data WDATA0–WDATA15 (see address "ADRS+1" in FIG. 9). At time t6, the control portion 8 raises the write signal WRITE up to the high level, and consequently, the lower-order-bit write data WDATA0–WDATA15, outputted onto the data bus, is written in the data RAM 14 at the predetermined address.

<READ OPERATION>

Next, the reading operation will be described. At time t7 shown in FIG. 9, the control portion 8 outputs the memory-access-sequence start signal SS to tile timing signal generating portion 11*g*. At the next leading edge timing of the clock $\phi_2$ (i.e., time t8), the address control portion shown in FIG. 5 outputs the address ADRS representing the read address. At the next leading edge timing of the clock $\phi_2$ (i.e., t9), both of the low-order-address updating signals AINC0, AINC1 are set at "0".

At this time, the address control portion outputs the address ADRS representing the read address on the basis of the low-order-address updating signals AINC0, AINC1 (both set at "0") and the designation signals AI0, AI1 (respectively set at "1", "0") used for designating the interconnection manner between the DSP 3 and data RAM 14. In this case, the address ADRS represents the read addresses for reading the higher-order read data RDATA16–RDATA31 (see "ADRS+0" in FIG. 9). At time t10, the control portion 8 raises the read signal READ up to the high level, with the result that the data RAM 14 outputs the data DATA16–DATA31 onto the data bus in accordance with the above-mentioned address ADRS (i.e., "ADRS+0").

At time t12, under control of the control portion 8, the latch-timing signals RDL0, RDL1 are set at the low level, while the other latch-timing signals RDL2, RDL3 are set at the high level. At this time, the designation signals AI0, AI1, representing the interconnection manner between the selector 11*d* and data RAM 14, are respectively set at "1", "0". Therefore, the data DATA24–DATA31 within the data DATA16–DATA31 is passed through the selector 11*d*1 and then stored in the buffer 11*e*1 of the read data buffer 11*e*, from which it is outputted to the latch circuit 11*h*. On the other hand, the other data DATA16–DATA23 is passed through the selector 11*d*2 and then stored in the buffer 11*e*2 of the read data buffer 11*e*, from which it is outputted to the latch circuit 11*h*.

At time t11 prior to the foregoing time t12, the address-update designating signal INC is set at the high level, so that the low-order-address updating signals AINC0, AINC1, outputted from the timing signal control portion shown in FIG. 4, are set at "01". As a result, the address ADRS representing the write address does not represent the read address for reading the lower-order read data RDATA0–RDATA15 (see "ADRS+1" in FIG. 9). At the next time t13, the data RAM 14 outputs the data DATA0–DATA15 onto the data bus in accordance with the address ADRS (i.e., "ADRS+1").

At time t14, under control of the control portion 8, the latch-timing signals RDL0, RDL1 are set at the high level, while the other latch-timing signals RDL2, RDL3 are set at the low level. Thus, the data DATA8–DATA15 within the data DATA0–DATA15 is passed through the selector 11*d*3 and then stored in the buffer 11*e*3 of the read data buffer 11*e*, from which it is outputted to the latch circuit 11*h*. On the other hand, the remaining data DATA0–DATA7 is directly stored in the buffer 11*e*4 of the read data buffer 11*e*, from which it is outputted to the latch circuit 11*h*.

In accordance with the latch-timing signals RDL0–RDL3, the latch-pulse generating portion 11*f* ralses the data-latch signal DLCH up to the high level. Thus, the 32-bit data DATA outputted from the read data buffer lie is latched by the latch circuit 11*h*, from which it is outputted onto the data bus DB as the read data RDATA.

(3) 24-Bit Data: 8-Bit Memory (three-piece data-division)

Figure 10:
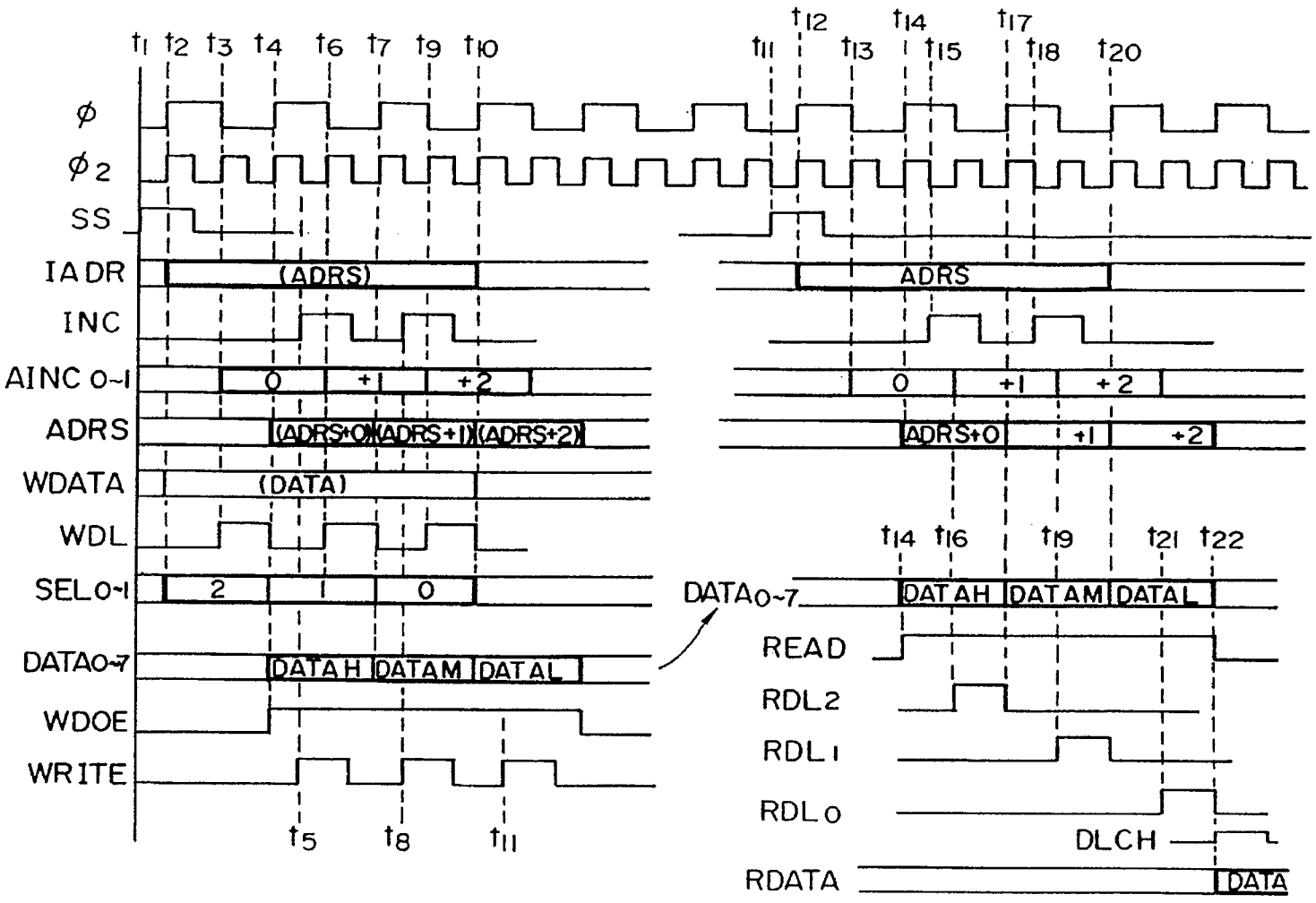

In this ease, 24-blt data is divided into three pieces, i.e., three sets of 8-bit data, on which The read/write operation is performed by use of the 8-bit memory. FIG. 10 is a timing chart, applied to this case, showing the read/write timings at several portions of the device. In this case, 8-bit data is transmitted between the data RAM 14 and the write data buffer 11*c* shown in FIG. 3, in which only the buffer 11*c*4 is used when writing the data therein. As for the read-side portion of the device, the 8-bit data is transmitted by use of the lower-order-eight-bit portion of the data bus DB.

<WRITE OPERATION>

Firstly, the wrltlng operation will be described. At time t1 in FIG. 10, the control portion 8 outputs the memory-access-sequence start signal SS to the timing signal generatlng portion 11*g*. At the next leading edge timing of the clock $\phi_2$ (i.e., time t2), 24-bit write data WDATA is outputted onto the data bus DB. At this time, the value of the 2-bit data consisting of the selecting signals SEL0, SEL1 is set at "2". Incidentally, the value of the selecting signal SEL2 does not affect the writing operation in this ease. At the next leading edge timing of the clock $\phi_2$ (i.e., time t3), the timing signal generating portion 11*g* sets the latch-timing signal WDL at the high level, and it also sets the low-order-address updating signals AINC0, AINC1 at "0". When the latch-timing signal WDL is set at the high level, every 8-bit data of the 24-bit write data WDATA is latched by the write data register 11*a*.

Since the selector 11*b* receives the bit-size recombination selecting signals SEL0, SEL1 of which values are set as described above, the selector 11*b*2 selects the higher-order write data WDATA16–WDATA23 from the write data WDATA outputted from the write data register 11*a*. Such higher-order write data WDATA16–WDATA23 is stored in the buffer 11*c*4 of the write data buffer 11*c*.

At time t4, the output control signal WDOE is set at the high level, so that the above-mentioned data WDATA16–WDATA23 stored in the buffer 11*c*4 (see "DATAH" shown in FIG. 10) is outputted onto the data bus. At this time, the address control portion (see FIG. 5) outputs the address ADRS representing the write address on the basis of the low-order-address updating signals AINC0, AINC1 (both set at "0") and interconnection-manner designation signals AI0, AI1 (respectively set at "1", "0"). In this case, the address ADRS represents the write address by which the higher-order-bit write data WDATA16–WDATA23 is written (see "ADRS+0" in FIG. 10). At time t5 when tile control portion 8 raises the write signal WRITE up to the high level, the above-mentioned higher-order-bit write data WDATA16–WDATA23 to be outputted onto the data bus is written in the data RAM 14 at the predetermined write address (i.e., "ADRS+0").

At the foregoing time t4, the latch-timing signal WDL is once set at the low level, while the decimal value of 2-bit data consisting of the selecting signals SEL0, SEL1 is set at "1". At time t6, the latch-timing signal WDL is set at the high level, so that the write data WDATA is latched by the write data register 11*a*. As described above, the decimal value of 2-bit data consisting of the blt-slze recombination selecting signals SEL0, SEL1 to be supplied to the selector 11*b* is set at "1". For this reason, the middle-order-bit write data DATA8–WDATA15 within the write data WDATA to be outputted from the write data register 11*a* is selected by the selector 11*b*2, and then it ls stored in the buffer 11*c*4 of the write data buffer 11*c*.

At time t5, both of the write signal WRITE and address-update designating signal INC are set at the high level. At the next leading edge timing of the clock $\phi_2$ after the time t5, the timing signal control portion (see FIG. 4) outputs the 2-bit data consisting of the low-order-address updating signals AINC0, AINC1, of which the decimal value is set at "+1".

At time t7, the output control signal WDOE is at the high level, with the result that the write data WDATA8–WDATA15 stored in the buffer 11*c*4 is outputted onto the data bus (see "DATAM" in FIG. 10). At this time, the address control portion (see FIG. 5) outputs the address ADRS representing the write address on the basis of the low-order-address updating Signals AINC0, AINC1 and interconnection-manner designation signals AI0, AI1 (respectively set at "1", "0"). In this case, the address ADRS represents the write address for writing the middle-order-bit write data WDATA8–WDATA15 (see "ADRS+1" in FIG. 10). At time t8 when the control portion 8 raises the write signal WRITE up to the high level, the above-mentioned write data WDATA8–WDATA15 to be outputted onto the data bus is written in the data RAM 14 at the predetermined write address (i.e., "ADRS+1").

At time t7, the latch-timing signal WDL is once set at the low level, while the decimal value of the selecting signals SEL0, SEL1 is set at "0". At time t9, the latch-timing signal WDL is set at the high level, so that the write data WDATA is latched by the write data register 11*a*. In this case, the decimal value of the selecting signals SEL0, SEL1 to be supplied to the selector 11*b* is set at "0". Therefore, the lower,order-bit write data WDATA0–WDATA7 within the write data WDATA outputted from the write data register 11*a* is selected by the selector 11*b*2, and then it is stored in the buffer 11*c*4 of the write data buffer 11*c*.

At the foregoing time t8, both of the write signal WRITE and address-update designating signal INC are set at the high level. At next leading edge timing of the clock $\phi_2$ after the time t8, the timing signal control portion outputs the low-order-address updating signals AINC0, AINC1, of which the decimal value is set at "2".

At time t10, the output control signal WDOE is at the high level, so that the above-mentioned write data WDATA0–WDATA7 (see "DATAL" in FIG. 10) stored in the buffer 11*c*4 is outputted onto the data bus. At this time, the address control portion (see FIG. 5) outputs the address ADRS representing the write address on the basis of the low-order-address updating signals AINC0, AINC1 and interconnection-manner designation signals AI0, AI1 (respectively set at "1", "0"). In this case, the address ADRS represents the write address for writing the lower-order-bit write data WDATA0–WDATA7 (see "ADRS+2" in FIG. 10). At time t11, the control portion 8 raises the write signal WRITE up to the high level, with the result that the lower-order-bit write data WDATA0–WDATA7 to be outputted onto the data bus is written in the data RAM 14 at the predetermined write address (i.e., ADRS+2").

<READ OPERATION>

Next, the reading operation will be described. At time t11 in FIG. 10, the control portion 8 outputs the memory-access-sequence start signal SS to the timing signal generating portion 11*g*. At the next leading edge timing of the clock $\phi_2$ (i.e., time t12), the address control portion (see FIG. 5) outputs the address ADRS representing the read address. At the next leading edge timing of the clock $\phi_2$ (i.e., time t13), the timing signal generating portion 11*g* sets the decimal value of the low-order-address updating signals AINC0, AINC1 at "0".

At this time, the address control portion outputs the address ADRS representing the read address on the basis of the low-order-address updating signals AINC0, AINC1

(both set at "0") and interconnection-manner designation siignals AI0, AI1 (respectively set at "1", "0"). In this case, the address ADRS represents the read address for reading the higher-order-bit read data RDATA16–RDATA23 (see "ADRS+0" in FIG. 10). At time t14, when the control portion 8 raises the read signal READ up to the high level, the data RAM 14 outputs the data DATA16–DATA23 (see "DATAH" in FIG. 10) onto the data bus in accordance with the address ADRS (i.e., "ADRS+0" in FIG. 10).

At time t16, the control portion 8 sets only the latch-timing signal RDL2 at the high level. At this time, the designation signals AI0, AI1 representing the interconnection manner between the selector 11*d* and data RAM 14 are respectively set at "1", "0". In other words, the decimal value of AI0, AI1 is set at "2". Thus, the above-mentioned data DATA16–DATA23 is supplied to the read data buffer 11*e* via the selectors 11*d*1–11*d*3. As described before, only the latch-timing signal RDL2 is set at the high level at time t16. Therefore, the data DATA16–DATA23 outputted from the selector 11*d*2 is stored in the buffer 11*e*2, from which it is outputted to the latch circuit 11*h*.

At time t15 just before the foregoing time t16, the address-update designating signal INC is set at the high level, so that the timing signal control portion outputs the low-order-address updating signals AINC0, AINC1, of which the decimal the value is at "1". As a result, the address ADRS represents the read address for reading the middle-order-bit read data RDATAS–RDATA15 (see "ADRS+1" in FIG. 10). At time t17, the data RAM 14 outputs the data DATA8–DATA15 (indicated by "DATAM" in FIG. 10) onto the data bus in accordance with the above-mentioned read address ADRS (i.e., "ADRS+1").

At time t19, under control of the control portion 8, only the latch-timing signal RDL1 is set at the high level, while the other latch-timing signals RDL0, RDL2 are set at the low level. Thus, only the data DATA8–DATA15 is selected by the selector 11*d*3 and then stored in the buffer 11*e*3, from which it is outputted to the latch circuit 11*h*.

At time t18 Just before the foregoing time t19, the address-update designating signal INC is set at the high level, and consequently, the decimal value of the low-order-address updating signals AINC0, AINC1, outputted from the foregoing timing signal control portion, is set at "2". As a result, the address ADRS represents the read address for reading he lower-order-bit read data RDATA0–RDATA7 (see "ADRS+2" in FIG. 10). At time t20, the data RAM 14 outputs the data DATA0–DATA7 (see "DATAL" in FIG. 10) onto the data bus in accordance with the above-mentioned read address ADRS (i.e., "ADRS+2" in FIG. 10).

At time t21, under control of the cqntrol portion 8, only the latch-timing signal RDL0 is set at the high level, while the other latch-timing signals RDL1, RDL2 remain at the low level. Thus, only the data DATA0–DATA7 outputted from the data RAM 14 is directly supplied to and then stored in the buffer 11*e*4, from which it ls outputted to the latch circuit 11*h*.

At time t22, the latch-pulse generating portion 11*f* sets the data-latch signal DLCH at the high level: in accordance with the above-mentioned latch-timing signals RDL0–RDL3. Thus, the 24-bit data DATA, outputted from the read data buffer 11*e*, is latched by the latch clrcult 11*h*, from which it is outputted onto the data bus as the 24-bit read data RDATA.

(4) 32-Blt Data: 8-Bit Memory (four-piece data-division)

Figure 11:
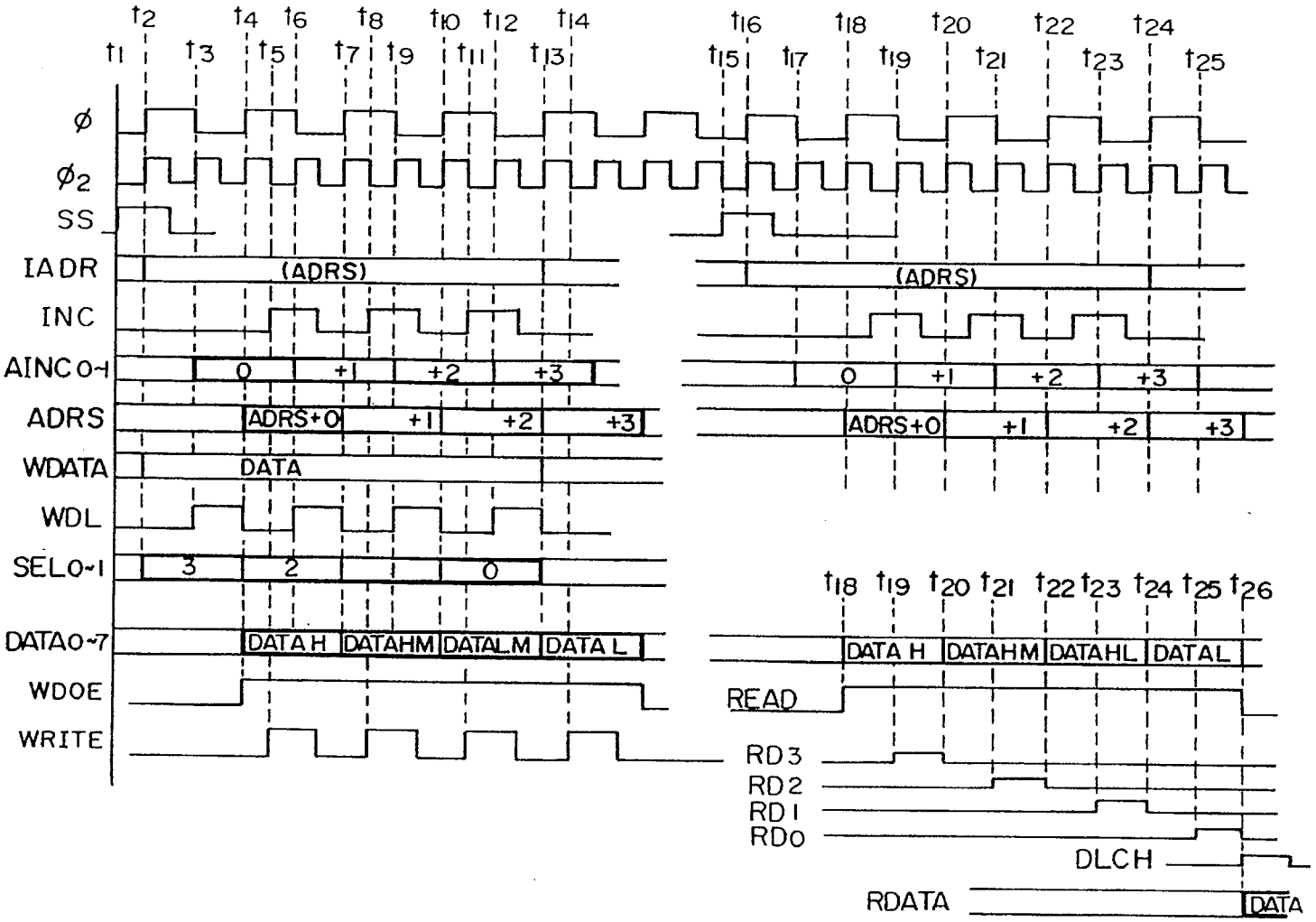

In this case, 32-bit data is divided into four pieces, i.e., four sets of 8-bit data, on which the read/write operation is performed by use of the 8-bit memory. FIG. 11 is a timing chart, applied to this case, showing the read/write timings at several portions of the device. Herein, 8-bit data is transmitted between the data RAM 14 and write data buffer 11*c* (see FIG. 3), in which only the buffer 11*c*4 is used. Similarly, in the read-side portion of the device, the 8-bit data is transmitted by use of the lower-order-eight-bit portion of the data bus.

<WRITE OPERATION>

Firstly, the writing operation will be described. At first time t1 in FIG. 11, the control portion 8 outputs the memory-access-sequence start signal SS to the timing signal generating portion 11*g*. At next leading edge timing of the clock $\phi_2$ (i.e., time t2), the 32-bit write data WDATA and memory address IADR are outputted onto the data bus DB. At this time, the decimal value of the selecting signals SEL0, SEL1 is set at "3". Incidentally, the other selecting signal SEL2 does not affect the writing operation in this case. At next leading edge timing of the clock $\phi_2$ (i.e., time t3), the timing signal generating portion 11*g* sets the latch-timing signal WDL at the high level, while the decimal value of the low-order-address updating signals AINC0, AINC1 is set at "0". Since the latch-tiding signal WDL is at the high level, every 8-bit data of the 32-bit write data WDATA is latched by the write data register 11*a*.

As described above, the decimal value of the bit-size recombination selecting signals SEL0, SEL1 is set at "3", so that the higher-order-bit write data WDATA24–WDATA31 outputted from the register 11*a*1 is selected by the selector 11*b*2, from which it is outputted to and then stored in the buffer 11*c*4 of the write data buffer 11*c*.

At time *t4*, the output control signal WDOE is raised up to the high level, with the result that the higher-order-bit write data WDATA24–WDATA31 (see "DATAH" in FIG. 11) stored in the buffer 11*c*4 is outputted onto the data bus. At this time, the address control portion (see FIG. 5) outputs the address ADRS representing the write address on the basis of the low-order-address updating signals AINC0, AINC1 (boih set at "0") and interconnection manner designation signalls AI0, AI1 (respectively set at "1", "0"). In this case, the address ADRS represents the write address for writing the higher-order-bit write data WDATA24–WDATA31 (see "ADRS+0" in FIG. 11). At time t5, when the control portion 8 raises the write signal WRITE up to the high level, the above-mentioned higher-order-bit write data WDATA24–WDATA31 is written In the data RAM 14 at the predetermined write address (i.e., "ADRS+0").

At the foregoing time t4, tile latch-timing signal WDL is once set at the low level, and the decimal value of the selecting signals SEL0, SEL1 is set at "2". At time t6, the latch-timing signal WDL is raised up to the high level, with the result that the write data WDATA is latched by the writedata register 11*a*. In this case, the decimal value of the selecting signals SEL0, SEL1 supplied to the selector 11*b* is set at "2". Thus, the selector 11*b*2 selects the write data WDATA16–WDATA23 within the write data WDATA outputted from the write data register 11*a*, and this selected write data is stored in the buffer 11*c*4 of the write data buffer 11*c*.

At the foregoing time t5, both the write signal WRITE and address-update designating signal INC are set at the high level. Thus, at the next leading edge timing of the clock $\phi_2$ (i.e., time t6), the decimal value of the low-order-address updating signals AINCO, AINC1, outputted from the timing signal control portion shown in FIG. 4, is set at "+1".

At time t7, the output control signal WDOE still remains at the high level, and the write data WDATA16–WDATA23

(see "DATAHM" in FIG. 11) stored in the buffer 11*c*4 is outputted onto the data bus. At this time, the address control portion shown in FIG. 5 outputs the address ADRS representing the write address on the basis of the low-order-address updating signals AINC0, AINC1 and interconnection manner designation signals AI0, AI1. Herein, the address ADRS represents the write address for writing the write address WDATA16–WDATA23 (see "ADRS+1" in FIG. 11). At time t8, when the control portion 8 raises the write signal WRITE up to the high level, the above-mentioned write data WDATA16–WDATA23 is written in the data RAM 14 at the predetermined write address (i.e., "ADRS+1").

At the foregoing time t7, the latch-timing signal WDL is once set at the low level, while the decimal value of the selecting signals SEL0, SEL1 is set at "1". At time t9, the latch-timing signal WDL is raised up to the high level, so that the write data WDATA is latched by the write data register 11*a*. In this case, the selector 11*b* receives the selecting signals SEL0, SEL1 having the decimal value "1". Therefore, the selector 11*b*2 selects the lower-order-bit write data WDATA8–WDATA15 within the write data WDATA outputted from the write data register 11*a*, so that the selected write data is stored in the buffer 11*c*4 of the write data buffer 11*c*.

At the foregoing time t8, both the write signal WRITE and address-update designating signal INC are set at the high level. Therefore, at the next leading edge timing of the clock $\phi_2$ (i.e., time t9), the foregoing timing signal control portion outputs the low-order-address updating signals AINC0, AINC1 having the decimal value "2".

At time t10. the output control signal WDOE is retained at the high level, so that the foregoing write data WDATAS–WDATA15 (i.e., "DATALH" shown in FIG. 11) stored in the buffer 11*c*4 is outputted onto the data bus. At this time, the foregoing address control portion shown in FIG. 5 outputs the address ADRS representing the write address on the basis of the low-order-address updating signals AINC0, AINC1 and interconnection manner designation signals AI0, AI1. In this case, the address ADRS represents the write address for writing the lower-order-bit write data WDATA8–WDATA15 (see "ADRS+2" in FIG. 11). At time t11, when the control portion 8 raises the write signal WRITE up to the high level, the above-mentioned lower-order-bit write data WDATA8–WDATA15 is written into the data RAM 14 at the predetermined address "ADRS+2".

At the foregoing time t10, the latch-timing signal WDL is once set at the low level, while the decimal value of the selecting signals SEL0, SEL1 is set at "0". At time t12, the latch-timing signal VL is raised up to the high level, by which the write data WDATA is latched by the write data register 11*a*. In this case, the decimal value of the bit-size recombination selecting signals SEL0, SEL1 is at "0" as described before. Thus, the selector 11*b*2 selects the lower-order-bit write data WDATA0–WDATA7 within the write data WDATA outputted from the write data register 11*a*, and the selectedwrite data is stored in the write data buffer 11*c*.

At the foregoing time tll, both the write signal WRITE and address-update designating signal INC are set at the high level. At the next leading edge timing of the clock $\phi_2$ (i.e., time t12), the foregoing timing signal control portion outputs the low-order-address updating signals AINC0, AINC1 having the decimal value "3".

At time t13, the output control signal WDOE is still retained at the high level. Therefore, the foregoing lower-order-bit write data WDATA0–WDATA7 (i.e. "DATAL" in FIG. 11) stored in the buffer 11*c*4 is outputted onto the data bus. At this time, the address control portion shown in FIG. 5 outputs the address ADRS representing the write address on the basis of the low-order-address updating signals AINC0, AINC1 and interconnection manner designation signals AI0, AI1. In this case, the address ADRS represents the write address for writing the lower-order-bit write data WDATA0–WDATA7 (see "ADRS+3" in FIG. 11). At time t14, when the control portion 8 raises the write signal WRITE up to the high level, the above-mentioned write data WDATA0–WDATA7 is written into the data RAM 14 at the predetermined write address "ADRS+3".

<READ OPERATION>

Next, the reading operation will be described. At time t15 shown in FIG. 11, the control portion 8 outputs the memory-access-sequence start signal SS to the timing generating portion 11*g*1 (see FIG. 4). At the next leading edge timing of the clock $\phi_2$ (i.e., time t16), the control portion 8 outputs the foregoing memory address IADR. At the next leading edge timing of the clock $\phi_2$ (i.e., time t17), the timing signal generating portion 11*g* sets the decimal value of the low-order-address updating signals AINCO, AINC1 at "0".

At this time, the address control portion modifies the memory address IADR to produce the address ADRS representing the read address for the data RAM 14 on the basis of the low-order-address updating signals AINCO, AINC1 (both set at "0") and interconnection manner designation signals AI0, AI1 (both set at "1"). In this case, the address ADRS represents the read address for reading the higher-order-bit read data RDATA24–RDATA31 (see "ADRS+0" in FIG. 11). At time t18, when the control portion 8 raises the read signal READ up to the high level, the data RAM 14 outputs the data DATA24–DATA31 (i.e. "DATAH") onto the data bus in accordance with the above-mentioned address ADRS (i.e., "ADRS+0" in FIG. 11).

At time t19, under control of the control portion 8, only the latch-timing signal RDL3 is set at the high level. At this time, the designation signals AI0, AI1 representing the interconnection manner between the selecttot 11*d* and data RAM 14 are both set at "1". In other words, the decimal value thereof is set at "3". Thus, the above-mentioned data DATA24–DATA31 is supplied to the read data buffer 11*e* via the selectors 11*d*1–11*d*3. At this time, only the latch-timing signal RDL3 is set at the high level as described before. Thus, the read data RDATA24–RDATA31 selected by the selector 11*d*1 is only stored in the buffer 11*e*1, from which it is outputted to the latch circuit 11*h*.

At the time Just before the foregoing time t19, the address-update designating signal INC is set at the high level. Thus, the foregoing timing signal control portion outputs the low-order-address updating signals AINC0, AINC1 having the decimal value "1". As a result, the address ADRS represents the read address for reading the read data RDATA16–RDATA23 (see "ADRS+1" in FIG. 11). At time t20, the data RAM 14 outputs the data DATA16–DATA23 (i.e., "DATAM" in FIG. 11) onto the data bus in accordance with the above-mentioned adress ADRS (i.e., "ADRS+1"). At time t21, under control of the control portion 8, only the latch-timing signal RDL2 is raised up to the high level. Thus, the data DATA16–DATA23 selected by the selector 11*d*2 is stored in the buffer 11*e*2, from which it is outputted to the latch circuit 11*h*.

At the time just before the foregoing time t21, the address-update designating signal INC is set at he high level. Thus, the timing signal control portion outputs the low-order-address updating signals AINC0, AINC1 having the decimal value "2". As a result, the address ADRS represents the read address for reading the read data RDATA8–RDATA15 (see "ADRS+2" in FIG. 11). At time t22, the data RAM 14 outputs the data DATA8–DATA15 (i.e., "DATAHL" in FIG. 11) onto the data bus in accordance with the above-mentioned address ADRS (i.e., "ADRS+2" in FIG. 11).

At time t23, under control of the control portion 8, only the latch-timing signal RDL1 is set at the high level. Thus, the data DATA8–DATA15 selected by the selector 11*d*3 is stored in the buffer 11*e*3, from which it is outputted to the latch circuit 11*h*.

At the time Just before the foregoing time t23, the address-update designating signal INC is raised up to the high level, so that the timing signal control portion outputs the low-order-address updating signals AINC0, AINC1 having the decimal value "3". As a result, the address MRS represents the read address for reading the read data RDATA0–RDATA7 (see "ADRS+3" in FIG. 11). At time t24, the data RAM 14 outputs the data DATA0–DATA7 (i.e., "DATAHL") onto the data bus in accordance with the address ADRS (i.e., "ADRS+2").

At time t25, under control of the control portion 8, only the latch-timing signal RDL0 is raised up to the high level. Thus, the data DATA0–DATA7 outputted from the data RAM 14 is directly supplied to and then stored in the buffer 11*e*4, from which it is outputted to the latch circuit 11*h*.

In accordance with the latch-timing signals RDL0–RDL3, the latch-pulse generating portion 11*f* raises the data-latch signal DLCH up to the high level at time t26. Thus, the 32-bit data DATA outputted from the read data buffer 11*e* is latched by the latch circuit 11*h*, from which it is outputted onto the data bus DB as the 32-bit read data RDATA.

(5) Refresh Operation

Figure 12:
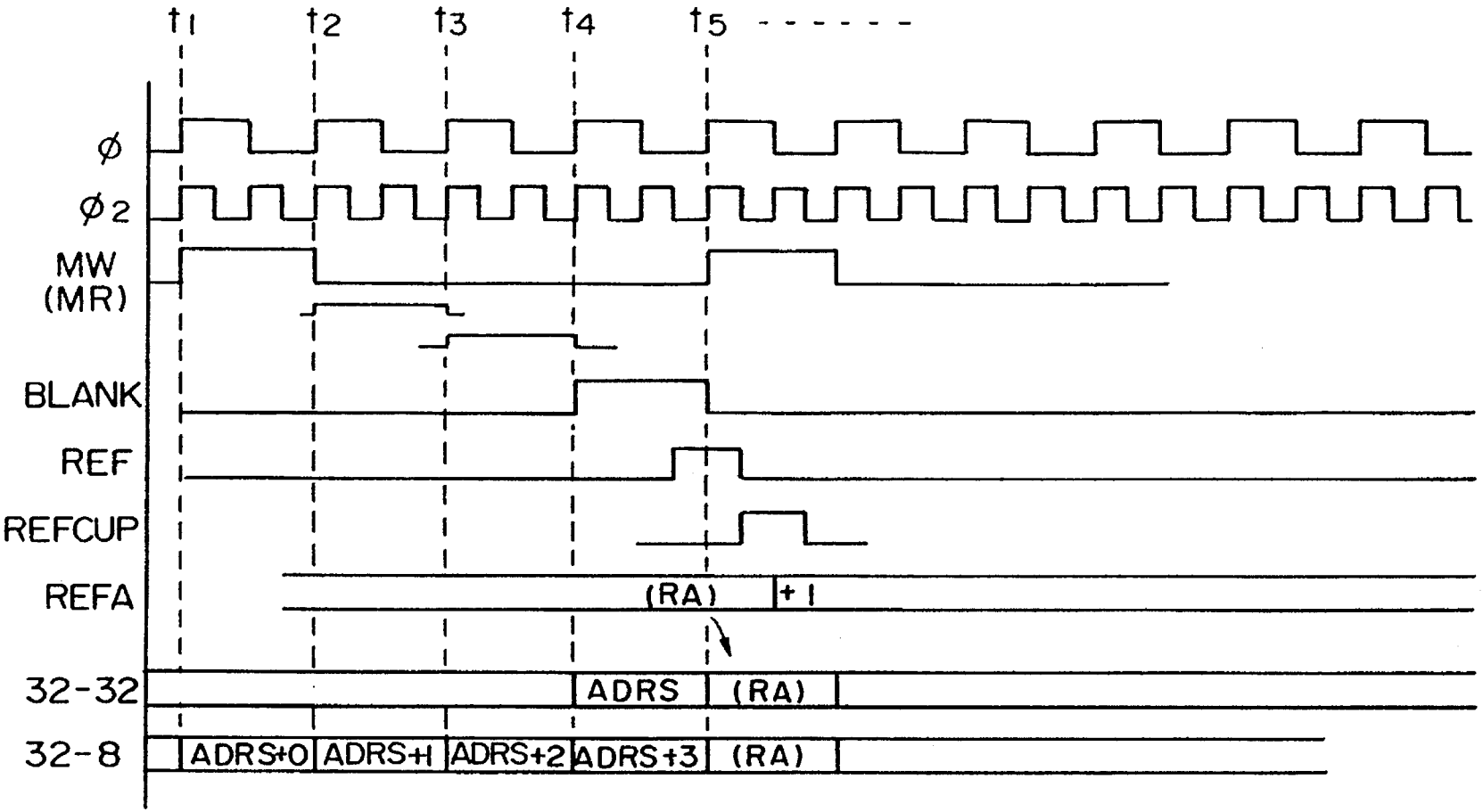
FIG. 12 is a timing chart for explaining the address control operation at the refresh operation.

FIG. 12 is a timing chart for explaining the address control operation at the refresh operation. In FIG. 12, when the data RAM 14 is accessed, the foregoing memory write signal MW or memory read signal MR is outputted by every one cycle of the clock $\phi_2$ at times t1, t2, t3, . . . In this case, the so-called refresh operation is carried out.

If the foregoing memory write signal MW or memory read signal MR is not outputted during the period of time corresponding to three cycles of the clock $\phi$, the blank signal BLANK is raised up to the high level at time t4, for example. Until the next memory write signal MW or memory read signal MR is outputted (in other words, until the signal MW or MR is raised up to the high level), this high-level blank signal BLANK is retained as it is. Thus, the refresh operation is carried out.

After the above-mentioned blank signal BLANK is set at the high level, the timing signal REF representing the memory refresh period is set at the high level. At the time next to the timing when the timing signal REF is set at the high level, the address output portion (shown in FIG. 5) of the data-memory-address control portion 10 modifies the refresh address REFA to produce the address ADRS. In accordance with the modified address ADRS, the control portion 8 and data R/W control portion 11 performs the read/write operation.

(6) Address Control Operation at Memory Clear Operation

Figure 13:
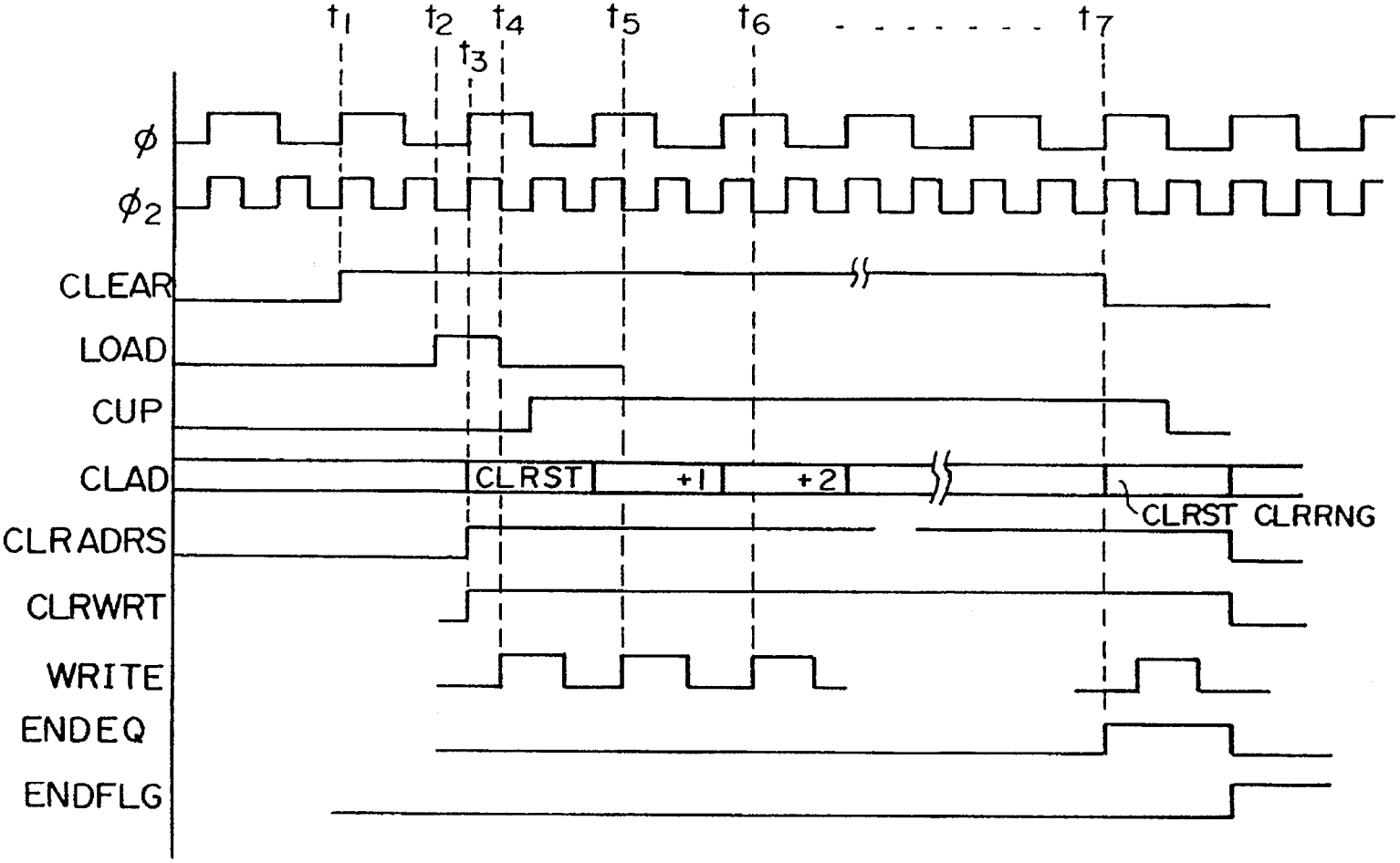
FIG. 13 is a timing chart for explaining the address control operation at the memory clear operation.

FIG. 13 is a timing chart for explaining the address control operation to be made at the memory clear operation. At time t1 in FIG. 13, the foregoing clear-start designating signal CLEAR, which is used for clearing the data RAM 14, is set at the high level. At the next time t2, the foregoing memory-clear-start-address load signal LOAD, which is used for reading the start address of the memory to be cleared, is set at the high level. At the next leading edge timing of the clock $\phi_2$ (i.e., time t3) next to the timing when the above-mentioned signal LOAD is set at the high level, the clear-start-address data CLRST, by which the clear operation is started, is supplied to the clear address generating portion shown in FIG. 7.

At the above-mentioned time t3, both the memory-clear-address-output selecting signal CLRADRS and memory write signal CLRWRT at the clear operation are set at the high level. Every time the write signal WRITE is raised up,to the high level (e.g., time t4, t5, t6), the data RAM 14 is cleared with respect to the address to be incremented. At time t7 when the memory-clear start signal CLEAR has fallen down to the low level, the memory-clear-end-address detecting signal ENDEQ is raised up to the high level. Thus, the clear operation is ended, and then the clear-end flag ENDFLG, declaring that the clear operation is ended, is set at the high level.

As described heretofore, the DSP according to the present embodiment performs the data processings and operations by use of the 32-bit or 24-bit data to be supplied thereto. This DSP can be coupled to the data RAM of which bit size can be arbitrarily selected from 32 bits to 8 bits. As a result, it is possible to reduce the number of the lines required in the data bus, by which the cost required for interconnecting the ICs can be reduced.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone and effect imparting signal processing device for use with a memory, the musical tone signal processing device comprising:

micro-program storing means for storing micro-programs, so that the micro-programs are sequentially read out from said micro-program storing means;

signal processing means for performing signal processing in accordance with a procedure which is controlled by said micro-programs;

memory-access-blank period detecting means for detecting a memory-access blank period by detecting whether the memory is not accessed by the micro-programs for a certain period of time;

refresh-address creating means for creating a refresh address; and memory-address control means for outputting an address to the memory in response to the micro-programs, said memory-address control means outputting the refresh address when the memory-access blank period is detected.

2. A musical tone and effect imparting signal processing device according to claim 1, wherein the signal processing means includes:

a first data processing means for performing a first data processing on M-bit data using the micro-programs;

a second data processing means for performing a second data processing on N-bit data using the micro-programs, wherein M is larger than or equal to N; and a data converting means using the micro-programs, coupled between said first and second data processing means, for dividing the M-bit data processed in said first data processing means into a plurality of sets of N-bit data so as to sequentially transfer the plurality of sets of N-bit data to said second data processing means, said data converting means also re-converting the N-bit data processed in said second data processing means into the M-bit data on the basis of a divided-data-transfer order, by combining the plurality of sets of N-bit data, by which the plurality of sets of N-bit data are sequentially transferred to said second data processing means, so as to transfer the re-converted M-bit data to said first data processing means.

3. A musical tone and effect imparting signal processing device according to claim 1, wherein the signal processing means includes:

a data processing means for performing a predetemined data processing on M-bit data using the micro-programs;

a data converting means using the micro-programs for converting the M-bit data in accordance with a data-conversion manner corresponding to a bit-size N of data used in the memory and dividing the M-bit data into sets of N-bit data (where M≧N), so that the sets of N-bit data are sequentially transferred to and stored in the memory; and a data re-converting means using the micro-programs for re-converting the N-bit data into the M-bit data on the basis of the data-conversion manner employed in said data converting means, by combining the sets of N-bit data, so that the re-converted M-bit data is transferred to said data processing means.

4. A musical tone and effect imparting signal processing device according to claim 3, wherein the M-bit data and the N-bit data are both multiples of eight, and are also set such that if M is not equal to N, M is a multiple of N.

5. A musical tone and effect imparting signal processing device according to claim 3, wherein said data processing means is a digital signal processor (DSP) which performs the predetemined data processing on the M-bit data, obtained fom the N-bit data stored in the menory, so as to produce a plurality of musical tone signals in time-division manner.

6. A musical tone and effect imparting signal processing device for use with a memory, the musical tone signal processing device comprising:

a micro-program storing circuit that stores micro-programs, so that the micro-programs are sequentially read out from the micro-program storing circuit;

a signal processing circuit that performs signal processing in accordance with a procedure which is controlled by the micro-programs;

a memory-access-blank period detecting circuit that detects a memory-access blank period by detecting whether the memory is not accessed by the micro-programs for a certain period of time;

a refresh-address creating circuit that creates a refresh address; and a memory-address control circuit that outputs an address to the memory in response to the micro-programs, the memory-address control circuit outputting the refresh address when the memory-access blank period is detected.

7. A musical tone and effect imparting signal processing device according to claim 6, wherein the signal processing circuit includes:

a first data processing circuit that performs a first data processing on M-bit data using the micro-programs;

a second data processing circuit that performs a second data processing on N-bit data using the micro-programs, wherein M is larger than or equal to N; and a data converting circuit using the micro-programs, coupled between the first and second data processing circuit, that divides the M-bit data processed in the first data processing circuit into a plurality of sets of N-bit data so as to sequentially transfer the plurality of sets of N-bit data to the second data processing circuit, the data converting circuit also re-converting the N-bit data processed in the second data processing circuit into the M-bit data on the basis of a divided-data-transfer order, by combining the plurality of sets of N-bit data, by which the plurality of sets of N-bit data are sequentially transferred to the second data processing circuit so as to transfer the re-converted M-bit data to the first data processing circuit.

8. A musical tone and effect imparting signal processing device according to claim 6, wherein the signal processing means includes:

a data processing circuit that performs a predetermined data processing on M-bit data using the micro-programs;

a data converting circuit that converts the M-bit data in accordance with a data-conversion manner corresponding to a bit-size N of data used in the memory and dividing the M-bit data into sets of N-bit data (where M≧N), so that the sets of N-bit data are sequentially transferred to and stored in the memory using the micro-programs; and a data re-converting circuit that re-converts the N-bit data into the M-bit data on the basis of the data-conversion manner employed in the data converting circuit, by combining the sets of N-bit data, so that the re-converted M-bit data is transferred to the data processing circuit using the micro-programs.

9. A musical tone and effect imparting signal processing device according to claim 8, wherein the M-bit data and the N-bit data are both multiples of eight, and are also set such that if M is not equal to N, M is a multiple of N.

10. A musical tone and effect imparting signal processing device according to claim 8, wherein the data processing circuit is a digital signal processor (DSP) which performs the predetermined data processing on the M-bit data, obtained from the N-bit data stored in the memory, so as to produce a plurality of musical tone signals in time-division manner.

11. A method of musical tone and effect imparting signal processing tbr use with a memory, the method comprising the steps of:

storing micro-programs so that the micro-programs are sequentially read;

performing signal processing in accordance with a procedure which is controlled by the micro-programs;

detecting a memory-access blank period by detecting whether the memory is not accessed by the micro-programs for a certain period of time;

creating a refresh address; and outputting an address to the memory in response to the micro-programs when the memory-access blank period is detected.

12. A method according to claim 11, wherein the step of performing signal processing includes:

performing a first data processing on M-bit data, wherein the M-bit data processed in said first data processing step is divided into a plurality of sets of N-bit data which are sequentially transferred using the micro-programs;

performing a second data processing on the sequentially transferred plurality of sets of N-bit data using the micro-programs, wherein M is larger than or equal to N; and re-converting the N-bit data processed in said second data processing step into the M-bit data on the basis of a divided-data-transfer order, by combining the plurality of sets of N-bit data, by which the plurality of sets of N-bit data are sequentially transferred to said second data processing step, so as to transfer the re-converted M-bit data to said first data processing step using the micro-programs.

13. A method according to claim 11, wherein the signal processing step includes:

performing a predetermined data processing on M-bit data using the micro-programs;

converting the M-bit data in accordance with a data-conversion manner corresponding to a bit-size N of data used in the memory and dividing the M-bit data into sets of N-bit data (where $M \geqq N$), so that the sets of N-bit data are sequentially transferred to and stored in the memory using the micro-programs; and re-converting the N-bit data into the M-bit data on the basis of the data-conversion manner employed in said data converting step, by combining the sets of N-bit data, so that the re-converted M-bit data is transferred to said data processing step using the micro-programs.

14. A method according to claim 13, wherein the M-bit data and the N-bit data are both multiples of eight, and are also set such that if M is not equal to N, M is a multiple of N.

15. A method according to claim 13, wherein the data processing step is performed by a digital signal processor (DSP) which performs the predetermined data processing on the M-bit data, obtained from the N-bit data stored in the memory, so as to produce a plurality of musical tone signals in time-division manner.

* * * * *